US006742482B2

(12) United States Patent
Artola

(10) Patent No.: US 6,742,482 B2
(45) Date of Patent: Jun. 1, 2004

(54) TWO-CYCLE INTERNAL COMBUSTION ENGINE

(76) Inventor: Jorge Artola, P.O. Box 40605, San Francisco, CA (US) 94140

( * ) Notice: Subject to any disclaimer, the term of this patent is extended or adjusted under 35 U.S.C. 154(b) by 210 days.

(21) Appl. No.: 09/935,447

(22) Filed: Aug. 22, 2001

(65) Prior Publication Data

US 2003/0037737 A1 Feb. 27, 2003

(51) Int. Cl.[7] ..... F02B 33/10

(52) U.S. Cl. ..... 123/71 R; 123/55.2; 123/662; 123/65 R

(58) Field of Search ..... 123/71 R, 65 R, 123/53.6, 59.7, 662, 53.3, 55.7, 55.2, 55.6

(56) References Cited

U.S. PATENT DOCUMENTS 2,132,595 A * 10/1938 Bancroft ..... 417/206
2,807,249 A * 9/1957 Peras ..... 123/55.6
3,886,805 A * 6/1975 Koderman ..... 74/52
4,485,768 A 12/1984 Heniges
5,884,590 A 3/1999 Minculescu
6,024,067 A 2/2000 Takachi et al.
6,209,495 B1 4/2001 Warren

* cited by examiner

*Primary Examiner*—Tony M. Argenbright
*Assistant Examiner*—Katrina B. Harris
(74) *Attorney, Agent, or Firm*—Weide & Miller, Ltd.

(57) ABSTRACT

A two-cycle engine having improved performance characteristics includes a block and a cylinder head coupled to the block, the cylinder head defining a cylinder bore and a precombustion chamber. The head of piston located in the cylinder bore divides the bore into first and second variable volume intake chambers. An intake port allows fresh air to be drawn into the variable volume intake chamber and be compressed by the moving piston and delivered to the precombustion chamber. Fuel is added to the compressed air, which is heated, and then delivered to the variable volume combustion chamber. In one embodiment, the piston drives a crankshaft which is mounted both for rotation and for translation. Another embodiment of the invention is a lubricating system for a piston where movement of the piston up and down generates a pumping effect moving lubricant through the piston for lubricating piston rings.

23 Claims, 14 Drawing Sheets

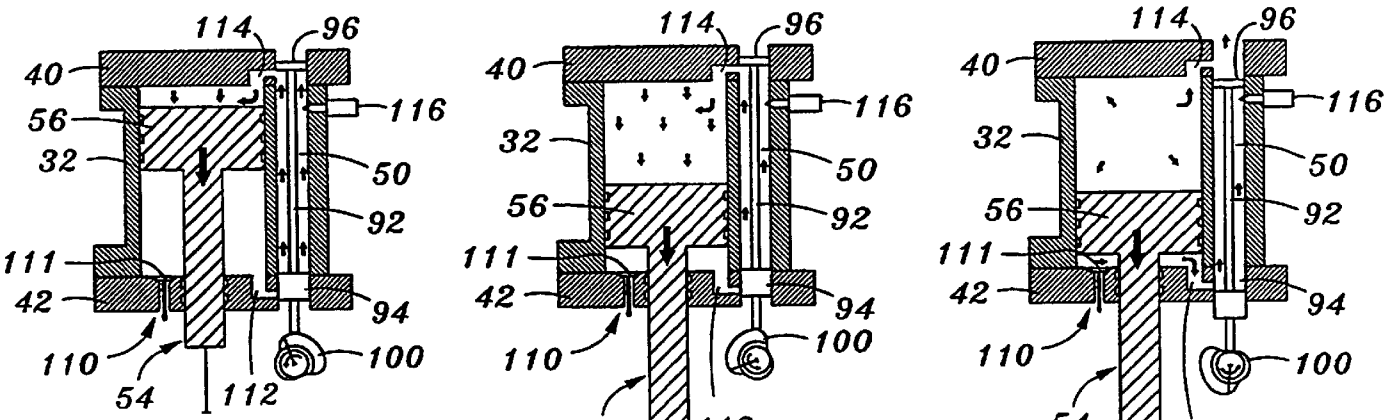
Fig. 22A
Fig. 22B
Fig. 22C
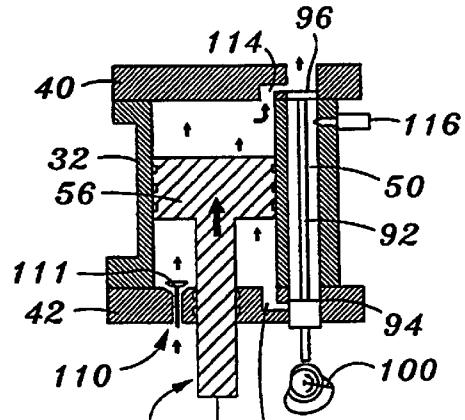
Fig. 22D
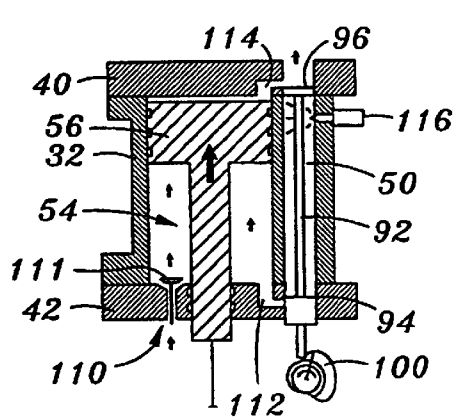
Fig. 22E
Fig. 22F

0°

45°

90°

135°

180°

225°

270°

315°
x
y
22
28
68
72
84
86

TWO-CYCLE INTERNAL COMBUSTION ENGINE

FIELD OF THE INVENTION

The present invention relates to two-cycle internal combustion engines, and more particularly to such an engine including a double-acting piston, a precombustion chamber and a translating and rotating crankshaft.

BACKGROUND OF THE INVENTION

In accordance with the laws of thermodynamics, it is desirable to provide an engine which maximizes pressure and temperature during combustion, as such results in the most efficient conversion of energy. In addition, in accordance with the laws of physics, the power to weight ratio of an engine increases as the speed of engine operation increases.

Unfortunately, a variety of secondary effects make difficult the achievement of an engine which achieves these objectives. As engine speed increases, so do the inertial forces and the stresses placed upon moving parts in the engine. At high speeds, the failure rate of these parts increases. Increasing the size of these parts to increase their strength has limited benefits, as such further increases the inertial forces and the total weight of the engine.

In some instances, current engine designs also do not permit ready solutions to these problems. For a number of reasons, traditional piston rods are much longer than the distance of the entire piston stroke. One advantage arising from a longer piston rods is such permits a longer piston stroke, and thus a higher compression ratio. The longer piston rod also provides greater clearance between the piston and crankshaft at bottom dead center. On the other hand, the longer piston rod is subject to high inertial forces.

A problem with raising engine temperatures and pressures is that the life of parts subjected to these high heat and pressures in the engine are reduced. In order to reduced the detrimental effects of the high heat, today's engines employ cooling systems. The cooling systems, however, serve to reduce the efficiency of the system.

Another problem with an engine operating at high speed is that the time for combustion is very short. To accommodate combustion time, combustion may be initiated before the piston is at top dead center. Combustion forces generated as the piston moves upwardly to top dead center act against the direction of the piston, contributing to a lower energy level of the engine. On the other hand, if combustion is not initiated until the piston is at top dead center, then total optimum combustion time is very short. As a result, the generated combustion force is limited, and so is the power output of the engine in relation to provided fuel.

Another disadvantage of a short combustion time is that certain less combustible alternative fuels are not usable in these engines. Simply, the combustion time is so short that slower combusting fuels do not sufficiently combust to generate efficient engine power. A problem with existing engines is that the optimal combustion time is so short, that it is detrimental to raise the speed of the engine because optimal combustion time is further shortened. This problem thus prevents achievement of an engine with otherwise higher efficiency by operation at higher speeds.

Two-cycle internal combustion engines have an advantage over four-cycle internal combustion engines in that an entire piston cycle is not lost without producing force. On the other hand, combustion effects are reduced due to incomplete scavenging: not all of the exhaust gasses are exhausted before combustion initiates, and insufficient incoming air is provided for complete combustion of the fuel.

One detrimental side effect of this incomplete combustion of fuel is the exhausting of unburned fuel and undesirable gasses. Due to the emission problems associated with two-cycle engines, in some instances U.S. laws prevent the operation of two-cycle engines.

An engine which is capable of exploiting the advantages of high pressures of combustion, high temperatures of combustion, and high engine speed is desired.

SUMMARY OF THE INVENTION

An improved internal combustion engine is disclosed. In one embodiment, the engine is a two-cycle engine with improved performance characteristics.

In one embodiment, the engine is an internal combustion engine including an engine block. Preferably, at least two cylinder heads are mounted to the block. A piston is movably mounted in a cylinder bore defined by each cylinder head. The cylinder bore is generally closed at its top and bottom, whereby the piston divides the bore into a first variable volume intake chamber and a second variable volume combustion chamber. The cylinder head farther defines a precombustion chamber, the precombustion chamber selectively in communication with the first variable volume intake chamber and the second variable volume combustion chamber.

At least one intake port is provided for permitting air to be drawn into the variable volume intake chamber. Air within the variable volume intake chamber is compressed when the piston in the cylinder bore moves downwardly.

At least one passage is provided for selectively permitting the compressed charge of air to flow into the precombustion chamber. Once in the precombustion chamber, the compressed air charge is heated, raising it to yet a higher pressure. A fuel delivery element is adapted to deliver fuel into the compressed air. A passage is provided permitting the fuel and air charge to flow from the precombustion chamber to the variable volume combustion chamber.

At least one valve is provided for selectively opening and closing the passage(s) between the variable volume intake chamber and the precombustion chamber, and the precombustion chamber and variable volume combustion chamber.

Ignition of the fuel and air mixture in the variable volume combustion chamber causes the piston to move downwardly in the cylinder bore. The piston is connected to a crankshaft which is mounted to the engine block.

In one embodiment, the block includes a first block gear and a second block gear. The crankshaft has a first end and a second end and at least one, and preferably two, piston mounting portions located between its ends. Each piston mounting portion is positioned along a first axis offset from a second axis through the first and second ends of the crankshaft. A first crankshaft gear is located at the first end of the crankshaft, the first crankshaft gear engaging the first block gear. A second crankshaft gear is located at the second end of the crankshaft, the second crankshaft gear engaging the second block gear. Movement of the piston causes the crankshaft to rotate about the second axis and the second axis to move in a generally circular pathway.

In one embodiment, the ends of the piston are supported by eccentric bearings. The bearings permit rotation and translation (i.e. movement of the rotational axis of the crankshaft) of the crankshaft.

In one embodiment of the invention, the block has four sides positioned between its ends. A cylinder head is coupled to each of the sides, and a piston is movably mounted in the cylinder bore defined by each head. The crankshaft includes a first piston mounting portion and a second piston mounting portion. A first pair of pistons mounted at opposing sides of the block are connected to one another about the first piston mounting portion. A second pair of pistons mounted at opposing sides of the block are connected to one another about the second piston mounting portion.

In one embodiment, the intake port includes an intake valve adapted to selectively open and close the intake port. A single valve is located in the precombustion chamber. The valve includes a first seal and a second seal. The first seal is adapted to selectively open and close the port or passage between the variable volume intake chamber and the precombustion chamber. The second seal is adapted to selectively open and close the port or passage between the precombustion chamber and the variable volume combustion chamber.

In one embodiment, the valve located in the precombustion chamber is driven by a rocker arm. The rocker arm is, in turn driven by an end of a follower. An opposing end of the follower is driven by a cam which is rotated by the crankshaft.

Another aspect of the invention is a lubricating and cooling system for a piston of an internal combustion engine, the piston having a head and a rod. A first end of the rod is coupled to the head and a second end of the rod is located opposite the first end thereof. A passage extends through the rod from the first end to the second end. An inlet leads from an exterior of the second end to the passage. At least one delivery passage is located in the head and extends from the passage in the head and returns to the passage in the rod. An outlet extends from the passage in rod.

At least one partition divides the passage through the rod into an inlet passage leading from the inlet to the delivery passage and an outlet passage leading from the delivery passage to the outlet. At least one lubrication directing element is located in the inlet passage and outlet passage, the at least one lubrication directing element generally inhibiting the flow of lubricant from the delivery passage to the inlet and from the outlet to the delivery passage.

Upward and downward movement of the piston during engine operation generates a pumping effect. Lubricant is drawn into the inlet and delivered to the head. The lubricant may be delivered through weeps to rings mounted on the exterior of the piston head. Excess lubricant is delivered back to the outlet.

Further objects, features, and advantages of the present invention over the prior art will become apparent from the detailed description of the drawings which follows, when considered with the attached figures.

DESCRIPTION OF THE DRAWINGS

FIGS. 22A–F are a series of figures illustrating an engine cycle of the engine of the present invention;

DETAILED DESCRIPTION OF THE INVENTION

Figure 2:
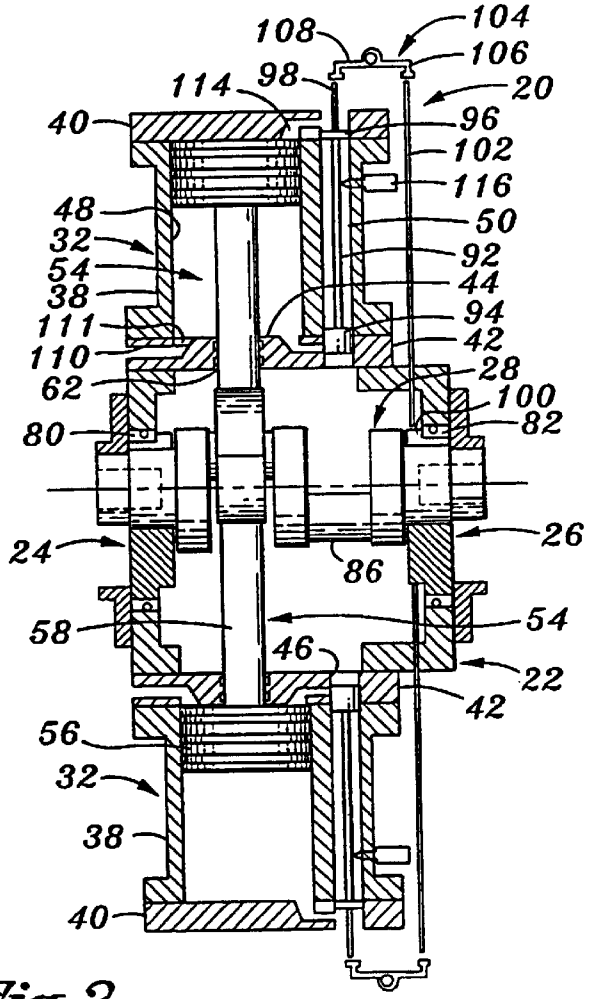
FIG. 2 is a cross-sectional view of the engine illustrated in FIG. 1 taken in the plane 2—2.

The invention is a two-cycle internal combustion engine. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention comprises an improved internal combustion engine. In a preferred embodiment, the engine is a two-cycle internal combustion engine. In accordance with the invention, such an engine is provided having a two-way acting piston, a precombustion chamber, an improved lubricating system for moving parts, and an output shaft mounting and drive arrangement. It will be appreciated that the invention extends to one or more of the features of the engine used alone or in combination with one another, and to such features as used in other than a two-cycle internal combustion engine.

One embodiment of an internal combustion engine 20 in accordance with the invention will be described with reference to FIGS. 1–3. The engine 20 includes a block 22. The block 22 is also illustrated in more detail in FIG. 3. The block 22 preferably comprises a housing defining one or more hollow interior areas. The block 22 has a first end 24 and a second end 26 which support a crankshaft 28, which crankshaft 28 is described in detail below. The crankshaft 28 extends through the generally hollow interior of the block 22.

The block 22 generally has four sides 30*a, b, c, d* between its ends 24, 26. Preferably, opposing pairs of sides are positioned in parallel, spaced apart planes, while adjacent sides adjoin at right angles. In this arrangement, the sides 30*a, b, c, d* define a generally cube-shaped block.

Each side 30*a, b, c, d* defines a mounting area for a head 32. Referring to FIG. 3, in one embodiment, each side 30*a, b, c, d* includes a main piston opening 34 and a valve opening 36. Preferably, these openings 34, 36 are in communication with the hollow interior area of the block 22 housing the crankshaft 28.

Figure 1:
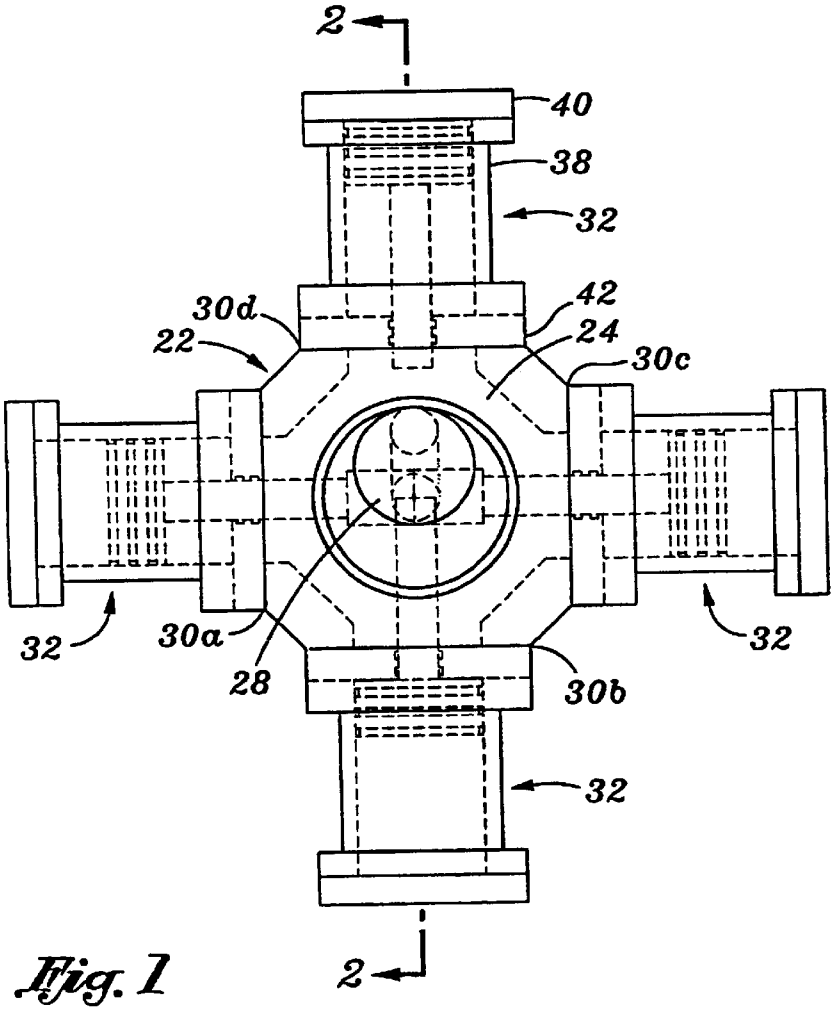
FIG. 1 is a plan view of an exterior of an embodiment of an engine in accordance with the present invention.
Figure 3:
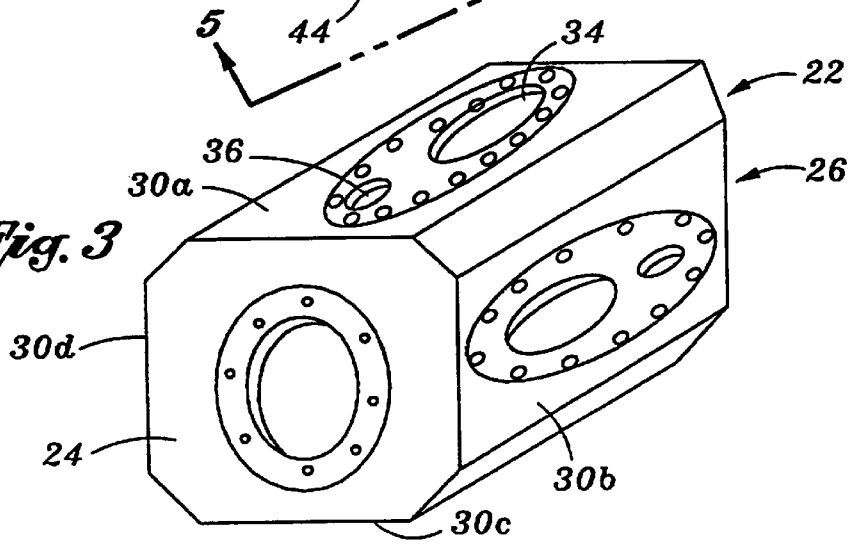
FIG. 3 is a perspective view of an engine block in accordance with an embodiment of the invention.

Referring to FIGS. 1 and 2, a head 32 is connected to each side 30*a, b, c, d* of the block 22. Each head 32 may be connected to the block 22 in a variety of manners, such as with nuts and bolts. In one embodiment, the heads 32 may be formed with the block 22 in whole or in part.

Figure 4:
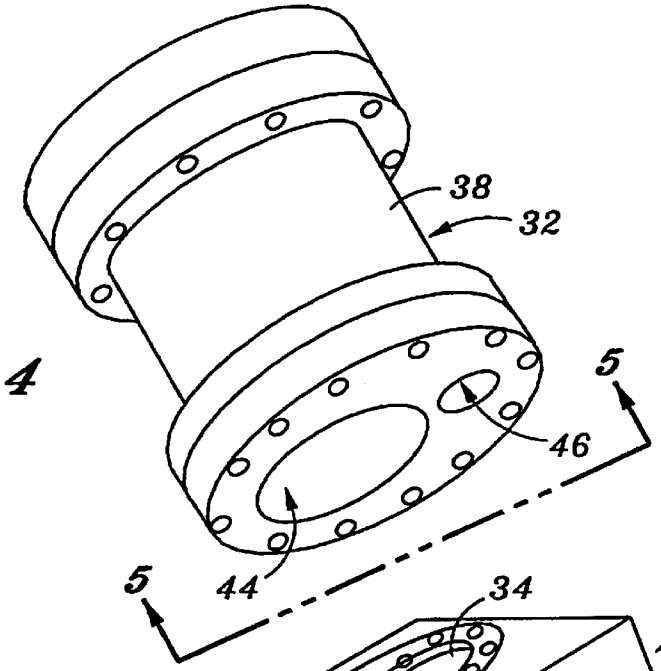
FIG. 4 is a perspective view of a cylinder head in accordance with an embodiment of the invention.

FIG. 4 illustrates the head 32 in perspective view. In a preferred embodiment, and referring to FIG. 2, each head 32 includes a body 38 and a cap 40. A bottom plate 42 is located at a first end of the body 38 of the head 32. The cap 40 is located at the opposing second end of the body 38 of the head 32. Preferably, when the head 32 is mounted to the block 22, the bottom plate 42 is positioned against the exterior of the side of the block 22. In one embodiment, the bottom plate 42 is formed integrally with the remainder of the body 38 of the head 32. Alternatively, the bottom plate 42 may be an independent element which is connected to the body 38 of the head 32.

Figure 12:
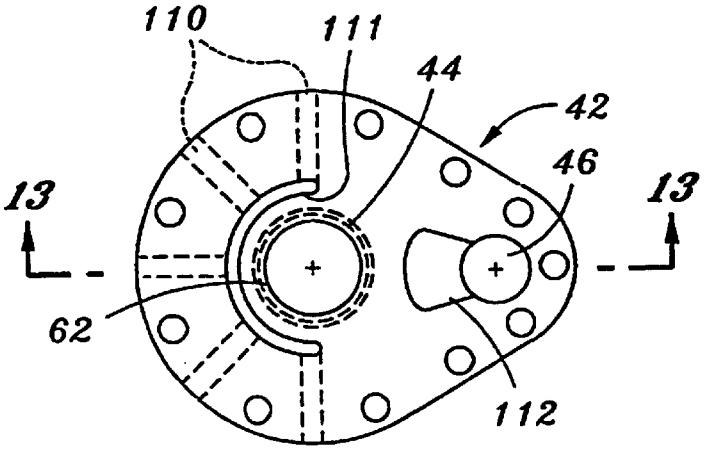
FIG. 12 is a top view of a bottom plate for the cylinder head illustrated in FIG. 4.

As illustrated in FIG. 12, the bottom plate 42 preferably includes a piston opening 44 and a valve opening 46. The size and orientation of these openings 44, 46 is preferably similar to that of the openings 34, 36 in the side of the block 22, whereby the openings in the block 22 and head 32 align when the head 32 is mounted to the block 22.

Figure 5:
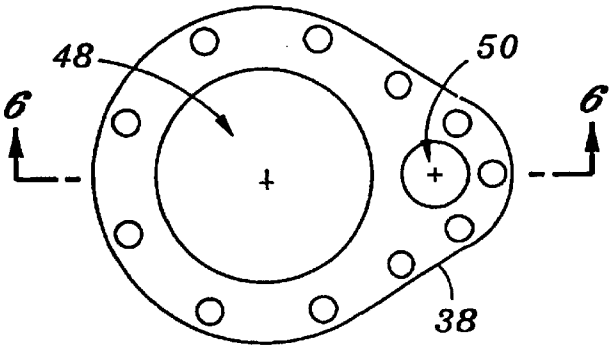
FIG. 5 is a bottom plan view of the cylinder head illustrated in FIG. 4.
Figure 6:
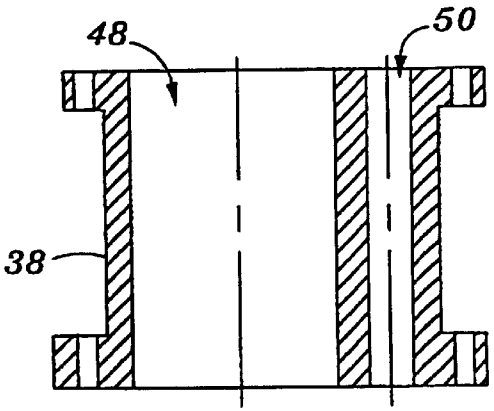
FIG. 6 is a cross-sectional view of the cylinder head illustrated in FIG. 5 taken along line 6—6 therein.

Referring to FIGS. 4–6, the body 38 of the head 32 defines a cylinder bore 48. The cylinder bore 48 is preferably an elongate cylindrical passage. The bore 48 may be of a variety of diameters. Referring to FIG. 2, when mounted, the piston opening 44 in the bottom plate 42 aligns with the cylinder bore 48 in the body 38. At the top end, the head cap 40 encloses the top of the cylinder bore 48. In a preferred embodiment, the head cap 40 is removable from the body 38 of the head 32, thus providing a means for access into the cylinder bore 48.

As illustrated in FIG. 6, the body 38 of the head 32 also defines a first or precombustion chamber 50. The first combustion chamber 50 is an elongate cylindrical bore extending from end-to-end through the body 38. In one embodiment, the diameter of the bore defining the first combustion chamber 50 is generally smaller than the diameter of the cylinder bore 48. Referring to FIG. 2, at the first end of the body 38, the valve opening 46 in the bottom plate 42 aligns with the first combustion chamber 50. At the top or second end of the body 38, the head cap 40 (see also FIG. 15) extends over but does not fully enclose the first combustion chamber 50. Instead, a small bore 52 is provided in the cap 40 in alignment with the bore defining the first combustion chamber for passage there through of a rod of a valve, as described in more detail below.

Figures 7, 8:
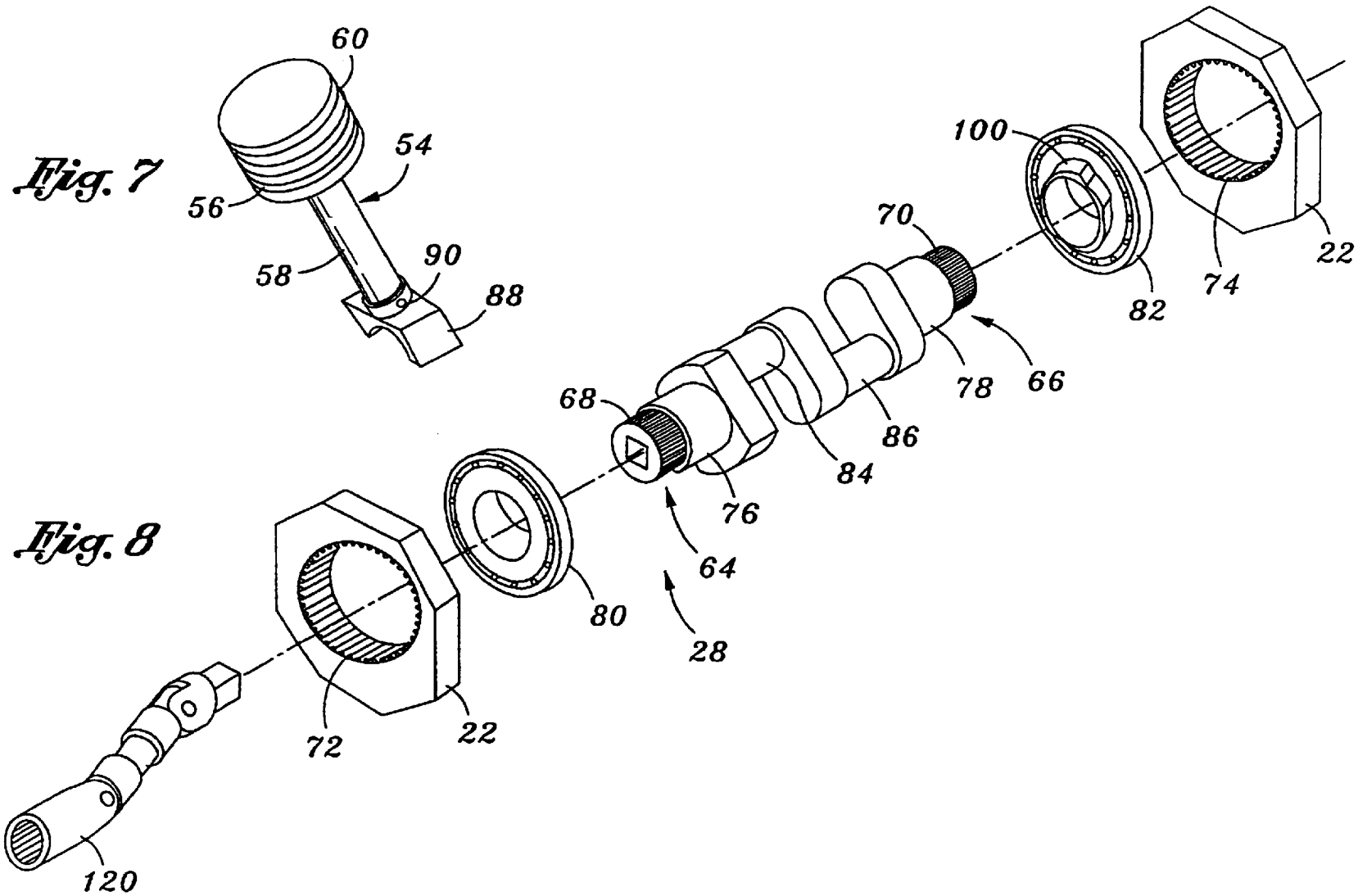
FIG. 7 is a perspective view of an embodiment of a piston in accordance with the invention.
FIG. 8 is a partial crankshaft assembly of the present invention illustrated in an exploded view.

A piston 54 is mounted in each cylinder bore 48 between the bottom plate 42 and the head cap 40. As best illustrated in FIG. 7, the piston 54 includes a head 56 and a rod 58 extending from the head 56. Preferably, the head 56 is a cylindrical body having a diameter slightly less than the diameter of the cylinder bore 48, and a height less than the length of the cylinder bore 48. The rod 58 is preferably a cylindrical member extending from the piston head 56 through the piston opening 44 in the bottom plate 42 to the crankshaft 28.

In one embodiment, one or more rings 60 are mounted on the exterior of the piston head 56. The rings 60 may include compression and oil rings, as are known in the art for sealing the piston head in the chamber, preventing gasses and fluids from moving from one side of the piston head to the other in the cylinder bore 48.

Referring to FIG. 2, a seal 62 is preferably provided for sealing the space between the piston rod 58 and the bottom plate 42 at the piston opening 44. The seal 62 may comprise a plurality of ring elements.

Still referring to FIG. 2, so mounted in its respective head 32, each piston 54 defines two variable volume chambers. A first variable volume chamber is located between the piston head 56 and the head cap 40. A second variable volume chamber is located between the piston head 56 and the bottom plate 42. As will be appreciated, as the piston 54 moves within the cylinder bore 48, the volumes of these chambers increase and decrease in proportion to one another. As will be appreciated later, the first chamber may be referred to as a variable volume combustion chamber, while the second as a variable volume intake chamber, owing to their functions.

As described in more detail below, combustion forces move the pistons 54 up and down within the cylinder bores 48. The movement of the pistons 54 is utilized to rotate the crankshaft 28.

Figure 9:
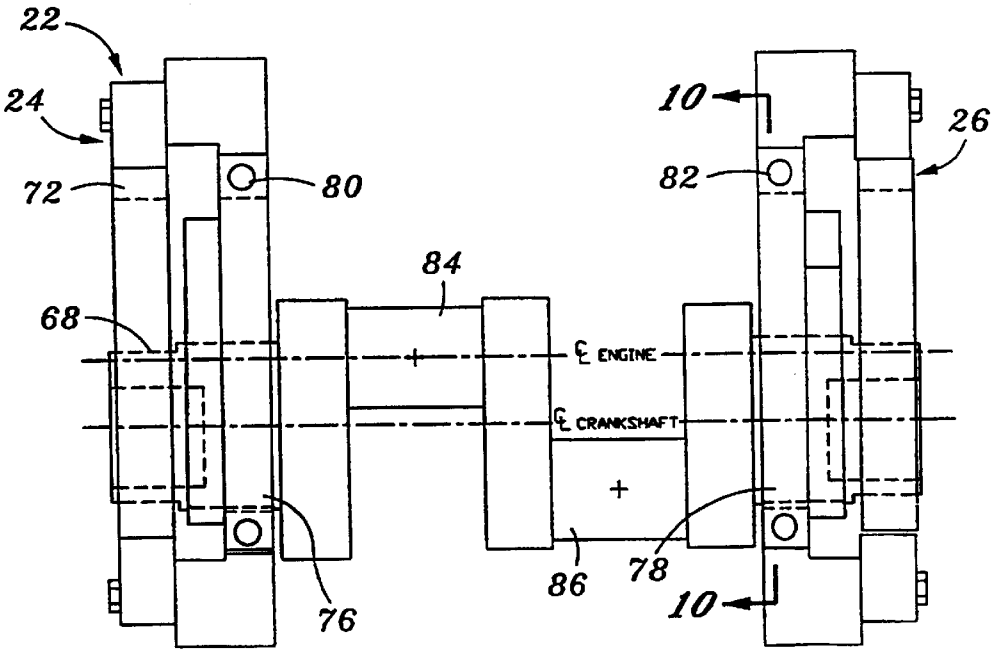
FIG. 9 is a side view of the crankshaft and a supporting assembly in accordance with the invention.

The crankshaft 28 will be described with reference to FIGS. 2, 8 and 9. The crankshaft 28 includes a body which is similar in many respects to crankshafts which are well known in the art. The crankshaft 28 has a first end 64 and a second end 66. The first and second ends 66 of the crankshaft 28 are rotatably supported by the block 22.

A first gear 68 is located at the first end 64 of the crankshaft 28. In one embodiment, the first gear 68 is integrally formed with the remainder of the crankshaft 28, and comprises a plurality of teeth formed about the exterior of the first end 64 of the crankshaft. The first gear 68 is configured to engage a first block gear 72. Preferably, the first block gear 72 comprises a gear member having teeth facing inwardly in a closed circular configuration. In one embodiment, the first block gear 72 may comprise a mating teeth formed in the block 22 at the crankshaft opening at the first end 24 of the block 22. In another embodiment, a gear body is mounted to the exterior of the block 22, the gear body having a passage there through defined by a circular inner wall or perimeter having the teeth formed thereon.

Preferably, the circumference of the first gear 68 of the crankshaft 28 is smaller than (as described below, preferably one-half the size of) the circumference of the first block gear 72. Rotation of the crankshaft 28 causes the first gear 68 to move in a circular motion about the first block gear 72.

In one embodiment, a second gear 70 is located at the second end 66 of the crankshaft 28. In one embodiment, the second gear 70 is integrally formed with the remainder of the crankshaft 28, and comprises a plurality of teeth formed about the exterior of the second end 66 of the crankshaft. The second gear 70 is configured to engage a second block gear 74. Preferably, the second block gear 74 comprises a gear member having teeth facing inwardly in a closed circular configuration. In one embodiment, the second block gear 74 may comprise mating teeth formed in the block 22 at the crankshaft opening at the second end 26 of the block 22. In another embodiment, a gear body is mounted to the exterior of the block 22, the gear body having a passage there through defined by a circular inner wall or perimeter having the teeth formed thereon.

Preferably, the circumference of the second gear 70 of the crankshaft 28 is smaller than (as described below, preferably one-half the size of) the circumference of the second block gear 74. Rotation of the crankshaft 28 causes the second gear 70 to move in a circular motion about the second block gear 74.

Figure 10:
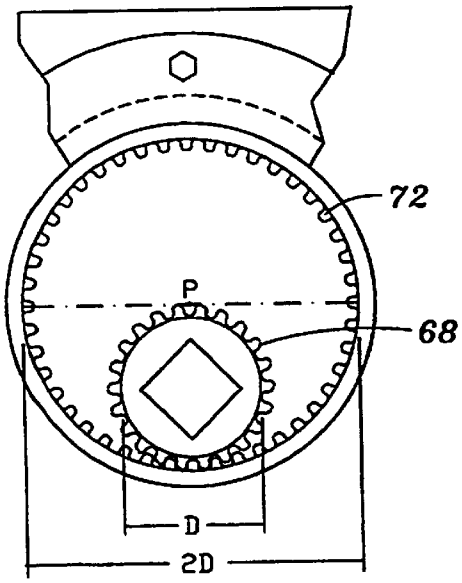
FIG. 10 illustrates the relationship between a crankshaft gear and supporting gear in accordance with an embodiment of the invention.

In a preferred embodiment, as best illustrated in FIG. 10, the diameter of the gear of the crankshaft 28 is D, while the diameter of the gear of the block 22 is 2D. In this arrangement, the diameter of the gear of the crankshaft is one-half of the size of the gear of the block.

The crankshaft 28 is preferably rotatably supported by the block 22, keeping the first and second crankshaft gears 68, 70 in contact with the first and second block gears 72, 74. In one embodiment, the crankshaft 28 includes a first journal portion 76 adjacent the first gear 68 and a second journal portion 78 adjacent the second gear 70. Each journal portion 76, 78 comprises a smooth cylindrical portion of the crankshaft body.

A first eccentric bearing 80 engages the first journal portion 76 of the crankshaft 28. The first eccentric bearing 80 is supported by the block 22. In an embodiment where the first block gear 72 is mounted external to the first end 24 of the block 22, the eccentric bearing 80 may be supported by the wall of the block 22 forming the first end of the block.

Likewise, a second eccentric bearing 82 engages the second journal portion 78 of the crankshaft 28. The second eccentric bearing 82 is supported by the block 22. In an embodiment where the second block gear 74 is mounted external to the second end 26 of the block 22, the eccentric bearing 82 may be supported by the wall of the block 22 forming the second end of the block.

The crankshaft 28 includes a first piston set mount or mounting portion 84 and a second piston set mounting portion 86. Each mount or mounting portion 84, 86 preferably comprises a generally smooth rod or cylinder-shaped portion of the crankshaft 28.

In a preferred embodiment, the mounts 84, 86 are offset and do not have their centers along the same axis. In one embodiment, as illustrated in FIG. 9, the crankshaft 28 includes a crankshaft centerline CL which extends through the first and second ends 64, 66 of the crankshaft 28. The axes through the center of each of the mounts 84, 86 are offset from the crankshaft centerline CL and from one another. In one embodiment, the mounts 84, 86 are aligned with a centerline of the engine CL at one or more times (when rotated into a particular position).

In one embodiment a first pair of opposing pistons 54 located nearest the first end 24 of the block 22 are connected to the first mount 84. A second pair of opposing pistons 54 located nearest the second end 26 of the block 22 are connected to the second mount 86. In one embodiment, each piston 54 is connected via a half-bearing 88 at the end of the piston rod 58 opposite the piston head 56. Referring to FIGS. 2 and 7, the half-bearing 88 is preferably designed to be connected to an opposing half-bearing associated with another piston. In this manner, opposing pistons 54 are mounted to one another about one of the piston mounting portions of the crankshaft 28. A pin 90 or other mounting may be used to connect the bearing 88 to the rod 58.

Referring again to FIG. 2, in a preferred embodiment of the invention, a valve 92 is associated with each first combustion chamber 50. In one embodiment, as illustrated in FIG. 11, the valve 92 is an elongate rod having a first end and a second end. A first seal 94 is located at the first end of the valve 92. The first seal 94 is preferably a circular disc located at the end of the rod forming the majority of the valve 92. The first seal 94 has an outer diameter slightly less than the inner diameter of the chamber 50.

A second seal 96 is located near the second end of the valve. The second seal 96 preferably also comprises a generally circular disk having a diameter slightly less than the inner diameter of the chamber 50.

A stem 98 is located at the second end of the valve 92. As illustrated, when positioned in the first or precombustion chamber 50, the first seal 94 is located near the bottom plate 42 of the cylinder head 32. The second seal 96 is located near the head cap 40. The stem 98 extends through the bore 52 in the cap 40 to a point external to the cylinder head.

Figure 11A:
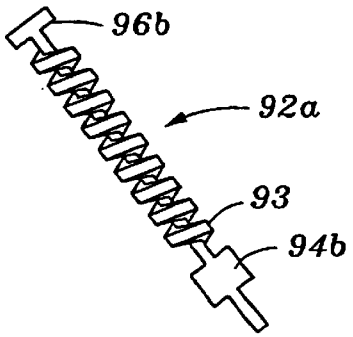
FIG. 11A is a perspective view of a valve rod with heat exchange element in accordance with another embodiment of the invention.
Figure 11:
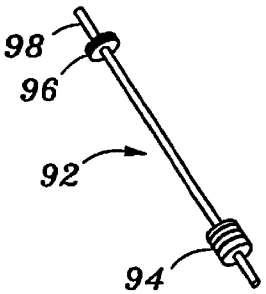
FIG. 11 is a perspective view of a valve rod in accordance with the invention.

FIG. 11A illustrates another embodiment of a valve 92*a*. In this embodiment, the valve 92*a* includes heat exchange element or member 93. In the embodiment illustrated, the heat exchange element 93 comprises a helical member position along a stem of the valve 92*a*. In general, the heat exchange element 93 is adapted to increase the surface area of the valve 92*a*, permitting a greater heat transfer rate. In on embodiment, the element 93 may be integrally formed with the stem or body portion of the valve 92*a*. Of course, other varieties of heat exchange elements may be utilized.

Referring to FIGS. 2 and 8, in a preferred embodiment, means are provided for moving the valve 92. In a preferred embodiment, the means includes a cam 100. In one embodiment, the cam 100 is mounted to the eccentric bearing 82 located at the second end of the crankshaft 28. The cam 100 has an outer surface which varies in distance from a rotational axis.

A follower 102 extends from the cam 100 upwardly from the cam 100 generally parallel to the cylinder head 32. A first end of the follower 102 engages the cam 100, such that rotation of the cam moves the follower up and down in accordance with the profile of the cam. Preferably, the profile of the cam 100 is appropriately configured to accomplish movement of the follower as described in detail below in conjunction with FIGS. 22A–F.

As illustrated in FIG. 2, a rocker 104 is located at the second end of the follower 102. The rocker 104 has a first arm 106 and a second arm 108 extending from either side of a pivot. The first arm 106 is arranged to engage a second end of the follower 102. The second arm 108 is arranged to engage the stem 98 of the valve 92. In one embodiment, a biasing means is provided for maintaining the follower 102 in engagement with the cam 100. The biasing means may comprise a spring associated with the rocker 104 causing the rocker to apply downward pressure upon the follower 104. As described in more detail below, upward movement of the follower 102 pushes the first arm 106 of the rocker upwardly, and thus the second arm 108 downwardly. Downward movement of the second arm 108 causes the valve 92 to be moved downwardly.

In one embodiment, the rocker 104 is mounted to the cylinder head 32. The rocker 104 and follower 102 may be located under a protective cover. Appropriate lubrication may be provided to these members. Of course, a follower 102 and rocker 104 are provided for each cylinder of the engine 20.

Biasing means may be provided for biasing the valve 92 upwardly, maintaining it in contact with the second arm 108 of the rocker 104. This biasing means may comprise a spring (not shown).

Passages are provided allowing air, fuel and mixtures of burned and unburned air and fuel to move in and out of the precombustion chamber 50 and cylinder bore 48. In one embodiment, as illustrated in FIG. 2, an intake passage or port 110 is provided to the cylinder bore 48. Preferably, the intake passage 110 is provided in communication with a portion of the cylinder bore 48 below the piston head 56. As illustrated, the intake port 110 extends from an exterior of the head 32 through the bottom plate 42 to the bore 48. As described in more detail below, the intake port 110 permits fresh air to be drawn into the cylinder bore 48.

Figure 13:
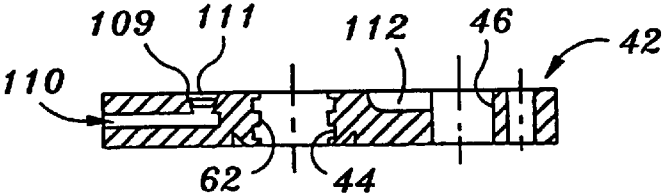
FIG. 13 is a cross-sectional view of the bottom plate illustrated in FIG. 12 taken along line 13—13 therein.

FIGS. 12 and 13 illustrate a preferred configuration of the bottom plate 42. As illustrated, the intake port 110 generally comprises a plurality of individual passages extending horizontally through the plate 42 to vertically extending inlet 109.

In one embodiment, a valve 111 is provided for selectively opening and closing the intake port 110. In a preferred embodiment, the valve 111 is a poppet type valve which is biased into a closed position. As described in more detail below, a condition of reduced pressure within the cylinder bore 48 causes the valve 111 to be moved upwardly as a result of the higher air pressure on the exterior side of the valve. As illustrated, the valve 111 is preferably "C" shaped and includes a head and a seating section, the seating section extending downwardly into the intake port 110 for use in guiding/aligning the valve 111.

A compression port 112 is provided between the cylinder bore 48 and the precombustion chamber 50. In a preferred embodiment, the compression port 112 extends from a portion of the cylinder bore 48 below the piston head 56 to the precombustion chamber 50. As illustrated, the compression port 112 is also provided in the bottom plate 42 of the cylinder head 32. A preferred arrangement of the bottom plate 42 including the compression port 112 is illustrated in FIGS. 12 and 13.

Figure 14:
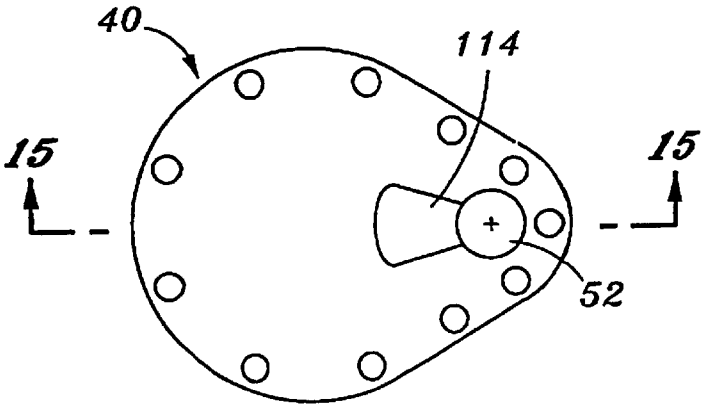
FIG. 14 is a bottom view of a cylinder cap for the cylinder head illustrated in FIG. 4.
Figure 15:
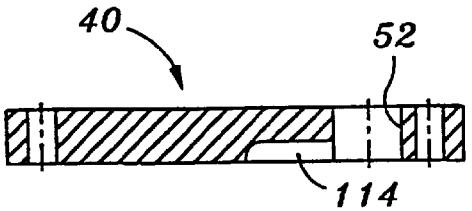
FIG. 15 is a cross-sectional view of the cylinder cap illustrated in FIG. 14 taken along line 15—15 therein.

As illustrated in FIG. 2, a bi-directional combustion and exhaust port 114 is provided as well. As illustrated, the bi-directional port 114 is provided in communication with a portion of the cylinder bore 48 above the piston head 56. At one or more times, the bi-directional port 114 is in communication with the precombustion chamber 50. As illustrated, the bi-directional port 114 is provided in the cylinder cap 40. A preferred configuration of the cylinder cap 40 is illustrated in FIGS. 14 and 15.

As described in more detail below, the valve 92 is designed to cooperate with the compression port 112 and bi-directional port 114. The locations of these ports and the configuration of the valve 92 are designed to provide a specific effect. In particular, movement of the first seal 94 of the valve 92 is adapted to open and close the compression port 112 at its entrance to the precombustion chamber 50. The movement of the second seal 96 of the valve 92 is adapted to open and close a pathway from the precombustion chamber 50 to the bi-directional port 114 leading to the cylinder bore 48.

The engine 20 includes a fuel delivery system. Such systems are well known and thus are not described herein. In general, the engine 20 may use any of a variety of known fuel delivery systems. Preferably, the fuel delivery system includes a fuel supply, a pump or other means for moving the fuel from the supply and pressurizing the fuel, and a fuel injector 116 for injecting fuel under pressure. In a preferred embodiment, the fuel injector 116 is arranged to deliver fuel into the precombustion chamber 50.

Appropriate controls are preferably provided for controlling the injector 116 associated with each cylinder 32. These controls are arranged to control the timing and duration of fuel delivery.

In a preferred embodiment, an ignition mechanism is provided for igniting a fuel and air mixture in the cylinder bore 48 above the piston head 56. In one embodiment, the ignition mechanism includes a spark plug (not shown). The spark plug preferably has a tip positioned in the cylinder bore 48, such as by threading the plug into a passage through the cylinder body 38 or the cylinder cap 40. A control and power delivery system may be provided for delivering electrical energy to the spark plug at the appropriate time for the start of ignition.

As illustrated in FIG. 8, in one embodiment of the invention, an output shaft 120 is provided. The output shaft 120 is preferably coupled to the crankshaft 28 for transferring rotational energy of the crankshaft 28 to another element, such as a transmission. As illustrated, the output shaft 120 preferably comprises a shaft having a universal joint. In one embodiment, the output shaft 120 is keyed at one end for insertion into a correspondingly shaped aperture in the first end of the crankshaft 28 at the first end 24 of the engine 20. The opposing end of the output shaft 120 is formed as a female coupling to accept a driven member.

Another aspect of the present invention is a lubricating system for one or more moving parts of the engine 20. In one embodiment, the invention is a lubricating system for each piston 54. In accordance with one embodiment of the invention, the rod 58 and at least a portion of each piston head 56 is hollow or has one or more passages there through.

Figure 16:
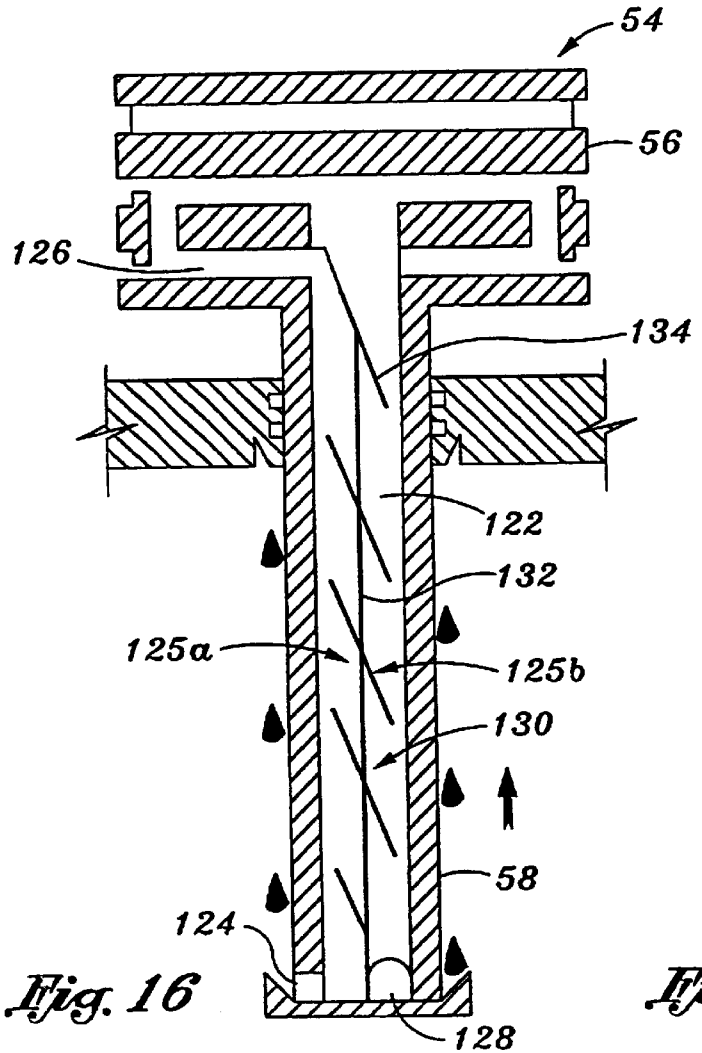
FIG. 16 is a cross-sectional view of a piston including a lubricating system in accordance with an embodiment of the invention.

As illustrated in FIG. 16, a main passage 122 is provided through the rod 58. An inlet 124 is provided from the exterior of the rod 58 to the main passage 122. At least one delivery passage 126 extends from the main passage 122 in the rod 58 through the piston head 56 to an outer area thereof for delivering lubricant to the rings 60. The delivery passage 126 preferably extends back to the main passage 122. An outlet 128 is provided from the main passage 122 to the exterior of the rod 58.

In one embodiment, the inlet 124 is formed near a trough defined by an outwardly extending member, such as a portion of the half-bearing or mount 88.

In accordance with the invention, there is provided a means for moving lubricant through the main passage 122 to the delivery passage 126 to the rings 60. In a preferred embodiment, the means comprises a linear pump cell 130. The linear pump cell 130 is located in the main passage 122 of the rod 58. The linear pump cell 130 comprises a partition 132 and a plurality of flow directing elements 134. Preferably, the partition 132 divides the main passage 122 into two portions, a first passage 125*a* leading from the inlet 124 to the delivery passage 126, and a second passage 125*b* leading from the delivery passage 126 to the outlet 128. As best illustrated in FIGS. 16–19, the flow directing elements 134 comprise generally flat, elliptically shaped members. The elements 134 are mounted to the partition 132 at an angle with respect to horizontal, and preferably such that they angle upwardly in the portion of the main passage 122 leading from the inlet 124 and downwardly in the portion of the main passage 122 leading to the outlet 128.

Figure 18:
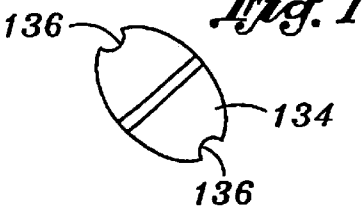
FIG. 18 is a perspective view of a diverter of the lubricating system illustrated in FIG. 17
Figure 19:
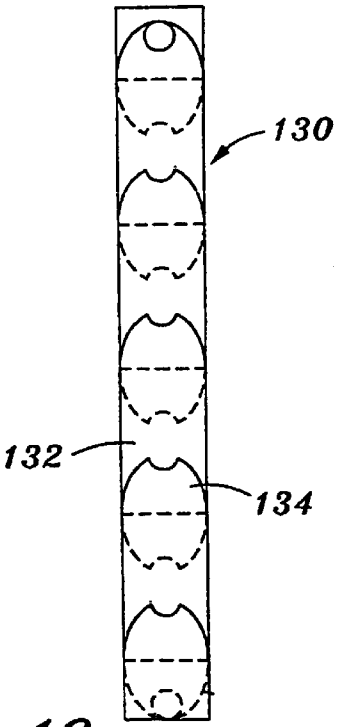
FIG. 19 is a front view of the assembly illustrated in FIG. 17.
Figure 17:
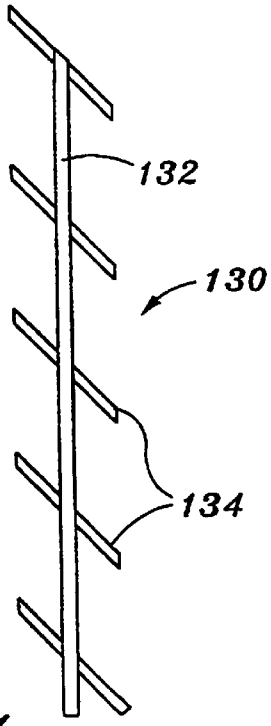
FIG. 17 is a side view of a lubricating system partition and diverter assembly for positioning in a piston as illustrated in FIG. 16.

As illustrated in FIG. 18, each flow directing element 134 includes a cut-out 136 at each end. When the flow directing elements 134 are located in the main passage 122, they substantially obstruct the main passage 122 except for the cut-out areas 136, which areas define a passage through which lubricant may flow. Details of the operation of the lubricating system are provided below in conjunction with FIGS. 24 and 25.

Figure 21:
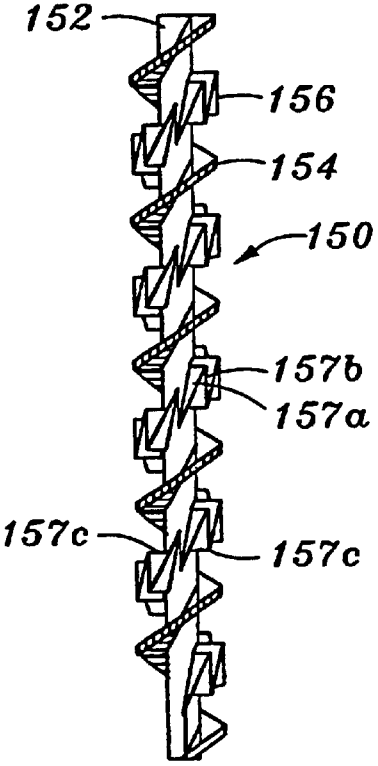
FIG. 21 is a plan view of a diverter of the lubricating system illustrated in FIG. 20.
Figure 20:
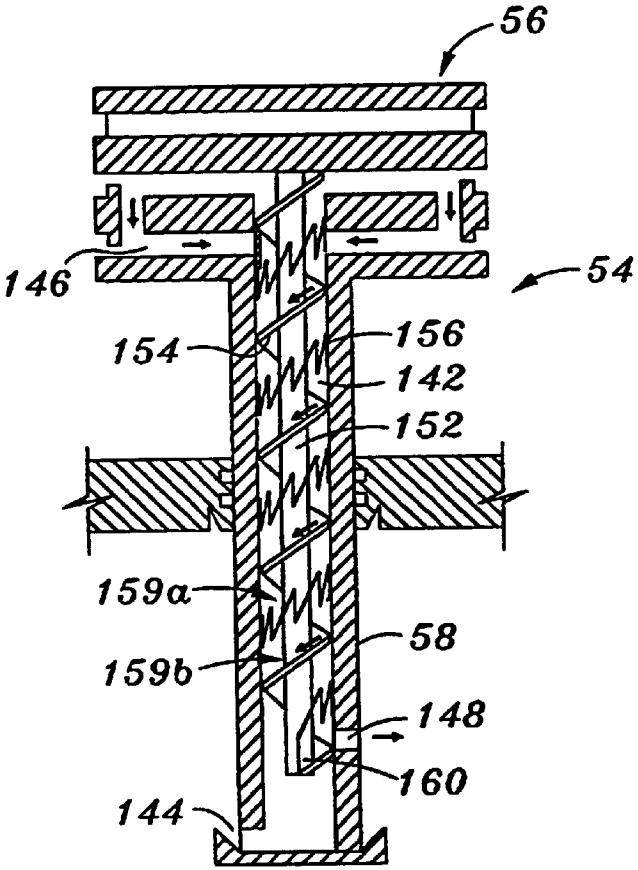
FIG. 20 is a is a cross-sectional view of a piston including a lubricating system in accordance with another embodiment of the invention.

Another embodiment of a lubricating system for a piston is illustrated in FIGS. 20 and 21. Similar to the lubricating system described above, at least a portion of each piston head 56 is hollow or has one or more passages there through. The piston 54 again includes a main passage 142 through the rod 58. An inlet 144 is provided from the exterior of the rod 58 to the main passage 142. At least one delivery passage 146 extends from the main passage 142 in the rod 58 through the piston head 56 to an outer area thereof for delivering lubricant to the rings 60. The delivery passage 146 preferably extends back to the main passage 142. An outlet 148 is provided from the main passage 142 to the exterior of the rod 58.

In accordance with the invention, there is provided a means for moving lubricant through the main passage 142 to the delivery passage 146 to the rings 60. In a preferred embodiment, the means comprises a linear pump cell 150. The linear pump cell 150 is located in the main passage 142 of the rod 58. The linear pump cell 150 comprises a support 152, a divider 154, and at least one flow directing element 156.

Referring to FIG. 21, in a preferred embodiment the support 152 comprises a rod or similar member. The dimension of the support 152 permits it to fit within the main passage 142 but leave substantial space between it and the rod 58 in which the passage 142 is formed.

The divider 154 comprises a helical wall which extends along the length of the support 152 and which extends outwardly therefrom. The divider 154 preferably extends outwardly from the support 152 a distance which causes it to abut the inside of the main passage 142 when the pump cell 150 is located therein. In this configuration, the divider 154 cooperates with the rod 58 and the support 152 to form a generally helical main passage 142.

The at least one flow directing element 156 comprises a stepped or laddered flow director. In a preferred embodiment, the flow directing element 156 extends in helical fashion around the rod 58. The element 156 is located in the helical passage 142 defined by the rod 58 and divide 154, further dividing the passage into a pair of passages 159*a, b*.

The element 156 includes alternating upwardly extending walls 157*a* and downwardly extending walls 157*b*. The upwardly extending walls 157*a* are slanted and extending upwardly a greater distance than the downwardly extending walls 157*b*. Preferably, the downwardly extending walls 157*b* are nearly vertical.

A trough 157*c* is formed at the intersection of each upwardly extending wall 157*a* and downwardly extending wall 157*b*. As described below, these troughs 157*c* hold lubricant in transport along the elements 156.

One of the passages 159*a* has its inlet in communication with the inlet 144 to the interior of the rod 58. This passage leads to the delivery passage 146.

The other of the two passages 159*b* leads from the delivery passage 146 to the outlet 148. In one embodiment, walls 160 are provided for dividing or sealing the passages 159*a*, 159*b* from one another.

Details of the operation of this embodiment lubricating system are provided below in conjunction with FIGS. 26–29.

Operation of the engine 20 described is as follows. In the description of the combustion cycle of the engine 20, with reference to FIGS. 22A–F (shown in general schematic form and not in exacting detail to the preferred embodiment of the invention described above and illustrated in FIGS. 1–21), reference is made to only a single cylinder of the engine 20. Referring to FIG. 22A, the piston 54 of the cylinder is illustrated just after it has reached its top dead center position and has begun to move downwardly. At this time, the area below the piston head 56 is filled with a fresh air charge. As noted, the cylinder head 32 and piston 54 cooperate to define a variable volume chamber below the piston head 56. At the point in time illustrated, this chamber is sealed, as the pressure of the air within the chamber has caused the valve 111 associated in the intake port 110 to close. In addition, the first seal 94 of the valve 92 is in a position in which it has closed the compression port 112, preventing the escape of air to the pre combustion chamber 50. As the piston 54 moves downwardly, the air within this variable volume chamber is compressed, raising its pressure.

In a preferred embodiment, combustion of the air and fuel begins in the precombustion chamber (such as described below, via initiation with heat of compression or a spark plug). Thus at the time illustrated, the pressurized air and fuel mixture formed within the precombustion chamber 50 which has already begun to ignite or burn flows into the variable volume combustion chamber located above the downwardly moving piston head 56. The fuel and air charge flows through the bi-directional port 114 as at this time the second seal 96 of the valve 92 is positioned above the port 114, and at the same time closes the exhaust pathway through the cylinder head cap 40. The burning of the charge causes the rapidly burning and expanding fuel and air mixture to force the piston 54 downwardly. The downward force of the piston 54 is used to drive the crankshaft 28, as is known in the art of reciprocating piston type internal combustion engines.

FIG. 22B illustrates the piston 54 as it is forced downwardly in a power stroke towards its bottom dead center position. At this time, the fresh air charge under the piston head 56 has been significantly compressed to a high pressure. The fuel and air charge above the piston head 56 has substantially completed combusting. During the movement of the piston 54 from near its top dead center to near its bottom dead center it will be seen that the valve 92 remains in a relatively constant position. It is noted that as the piston 54 moves downwardly, the increase in volume draws the pressurized fuel and air charge from within the precombustion chamber 50 into the combustion chamber.

FIG. 22C illustrates the piston 54 at nearly its bottom dead center position. At this time, rotation of the cam 100 to a new profile area has resulted in movement of the valve 92. As illustrated, the valve 92 has been permitted to move downwardly with respect to the cylinder head 32. The first seal 96 is in a position in which it no longer obstructs the compression port 112. At the same time, the second seal 98 has moved into a position in which is obstructs a top portion of the pre combustion chamber 50, sealing it from the bi-directional port 114.

When the first seal 94 moves into a position in which is no longer obstructs the compression port 112, the compressed fresh air charge flows into the lower pressure precombustion chamber 50. Thus, the precombustion chamber 50 is filled with a charge of fresh air at high pressure.

At the same time, the combusted fuel and air charge above the piston head 56 is permitted to begin flowing from the combustion chamber through the bi-directional port 114 and the bore 52 in the head cap 40. Preferably, the exhaust flows into an exhaust pathway leading to a catalytic converter and muffler then to a point of discharge from the engine 20.

FIG. 22D illustrates the piston 56 after it has reach its bottom dead center position and has begun to move upwardly. At this time, the cam 100 has rotated to a position in which it has forced the valve 92 upwardly. The valve 92 has been moved upwardly a sufficient distance that the first seal 94 again seals or closes the compression port 112. However, the second seal 94 still seals the top of the precombustion chamber 50, preventing escape of the fresh air charge in the precombustion chamber. Importantly, at this time, the already mechanically pressurized fresh air charge within the precombustion chamber is further pressurized. Heat of combustion from within the precombustion chamber 50 from the previous cycle heats the newly introduced air in the precombustion chamber 50. In addition, some heat from cylinder bore passes through the body of the cylinder head 32.

As the piston 54 moves upwardly, a condition of reduced pressure is created under the piston head 56. Higher pressure fresh air on the opposing side of the valve 111 moves the valve 111 into its open position, permitting fresh air to flow through the inlet port 110 into the chamber below the piston 54.

Movement of the piston 54 upwardly forces the combusted air and fuel exhaust from the combustion chamber. The exhaust continues to flow out through the bi-directional port 114.

FIG. 22E illustrates the piston 54 as it moves towards its top dead center position. Fresh air continues to be drawn into the area below the piston 54. The exhaust continues to be forced out of the combustion chamber through the bi-directional port 114.

FIG. 22F illustrates the piston 54 at nearly its top dead center position. As illustrated, at this time, the valve 92 is in generally the same position as previously illustrated. The precombustion chamber 50 is sealed. Fuel is injected into the pressurized air charged in the precombustion chamber 50. The fuel is injected with the fuel injector 116 or similar member. Preferably, ignition of the air and fuel within the precombustion chamber 50 is then initiated, such as by a spark plug (not shown) or other ignition device.

The process then repeats at FIG. 10A, with the ignited fuel and air charge being released from the precombustion chamber into the main combustion chamber above the piston 54.

Each piston 54 preferably moves through this same cycle. In a preferred embodiment where more than one cylinder and corresponding piston are provided, one or more of the pistons are preferably arranged to be at a different point in the combustion/exhaust cycle at the same time. In this manner, as one piston is in a non-power producing portion of its cycle, another piston is in the power stroke portion, thus rotating the crankshaft and aiding in the movement of the other piston through the portion of its cycle which is non-power producing.

Movement of the crankshaft 28 during operation of the engine 20 will be described with reference to FIGS. 23A–H. The crankshaft 28 is shown as viewed towards its first end 64. In FIGS. 23A–H, the first gear 68 at the first end 64 of the crankshaft 28 is shown as engaged with the first block gear 72. The first and second mounting portions 84, 86 of the crankshaft 28 are also illustrated.

Figures 23A, 23B, 23C, 23D, 23E, 23F, 23G, 23H:
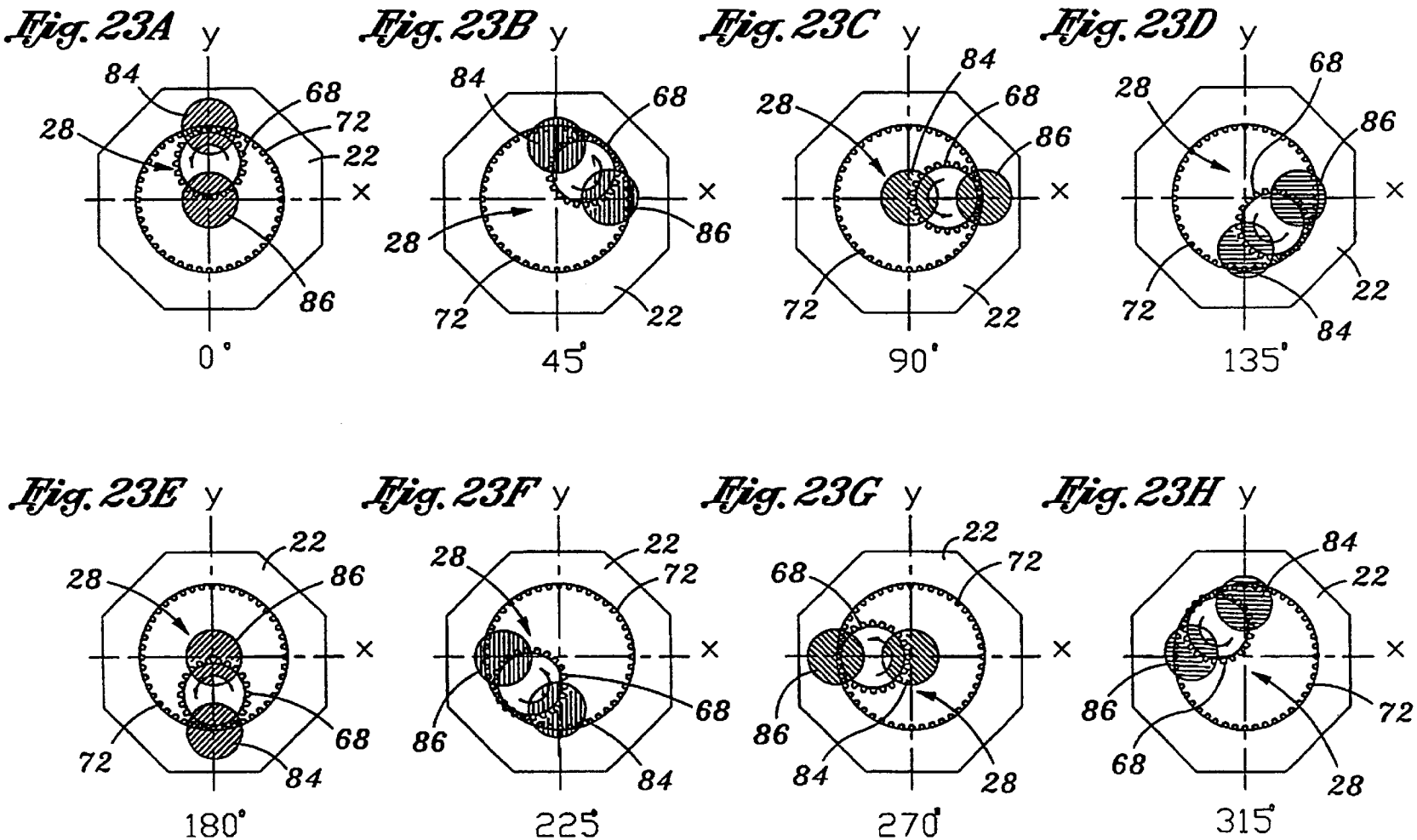
FIGS. 23A–H are a series of figures illustrating the movement of the crankshaft of the invention through a complete rotation thereof.

FIG. 23A illustrates the crankshaft 28 at an arbitrary position referred to as the 0 degree position. In this position, the first and second mounting portions 84, 86 and the first end of the crankshaft 28 are all aligned vertically. As a result of a power stroke and exhaust stroke of the pistons associated with the first and second mounts 84, 86, the first mounting portion 84 is driven downwardly, while the second mounting portion is driven outwardly. As a result, the crankshaft 28, which is rotating counter-clockwise, moves along the first block gear 72 in a clockwise direction. The crankshaft 28 is then in the position illustrated in FIG. 23B.

Further operation of the engine 20 causes the first mounting portion 84 to be driven downwardly until the first and second mounting portions 84, 86 and first end 64 of the crankshaft 28 are all aligned along a horizontal axis, as illustrated in FIG. 23C.

The first mounting portion 84 is driven further downward while the second mounting portion 86 begins its return, moving in the opposite direction. The crankshaft 28 continues to rotate, with the first end 64 moving further clockwise around the first block gear 72 to the position illustrated in FIG. 23D.

Further movement of the crankshaft 28 occurs in like manner as illustrated in FIGS. 23E through 23H until the crankshaft 28 returns to its original starting position.

It will now be appreciated that in a preferred embodiment, the first pair of pistons 54 move cooperatively to move the first mounting portion 84 of the crankshaft 28. When one piston of that pair is moving downwardly in its power stroke, it is forcing the other piston upwardly in an exhaust stroke. Likewise, the other pair of pistons are associated with the second mounting member 86. Moreover, the first and second mounting portions 84, 86 are offset so that the crankshaft 28 is translated, i.e. moved laterally or other than rotationally.

Because the crankshaft 28 translates, the attachment point of each piston 54 also moves, but a greater distance than if the crankshaft only rotated. In this configuration, the throw or maximum distance traveled by each piston 54 is great, even though the length of the piston rod is quite short.

Figure 24:
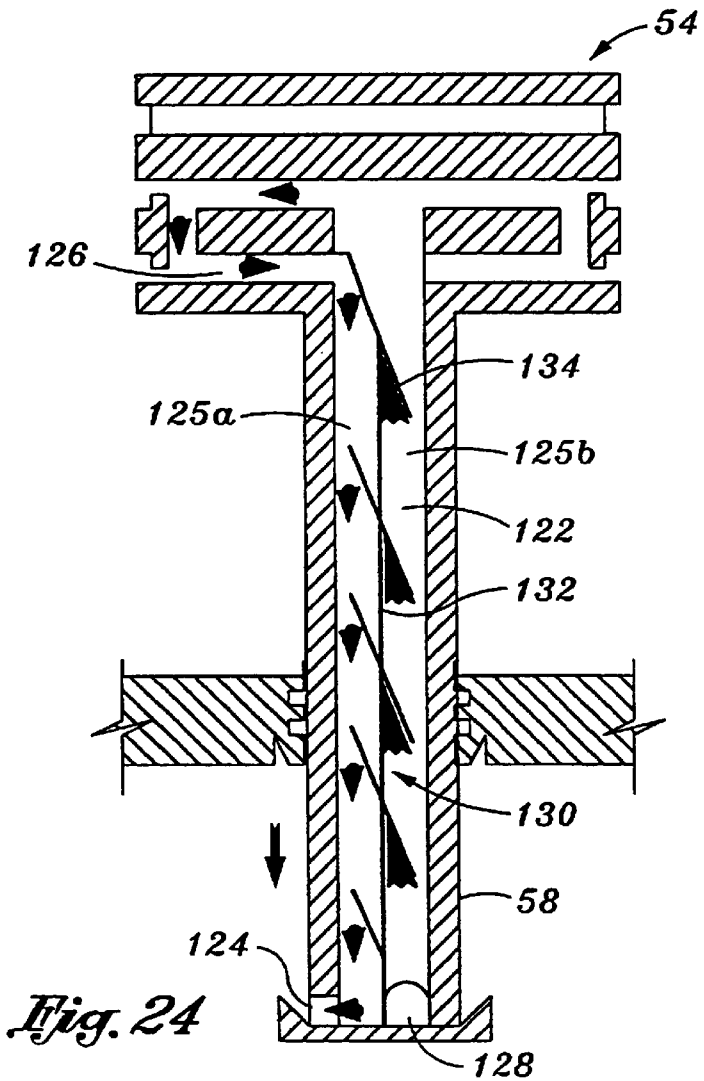
FIG. 24 is view of the piston illustrated in FIG. 16 shown moving downward and illustrating the movement of lubrication thereby.

Operation of the lubricating system for the pistons in accordance with the embodiment illustrated in FIGS. 16–19 will now be described in detail with reference primarily to FIGS. 24 and 25. In general, the operation of the lubricating system is in the nature of a linear pump. As the piston 54 moves downwardly, oil flows from the inlet 124 upwardly through the first passage 125*a* to the delivery passage 126. The upward flow occurs as lubricant passes through the cut-outs 136 in the elements 134. Notably, upward movement of oil from the outlet 128 through the second passage 125*b* is inhibited by the partition elements 132. The upward flow of oil forces oil through the various lubricating passages in the piston head and through lubricating weeps for lubricating the rings.

Figure 25:
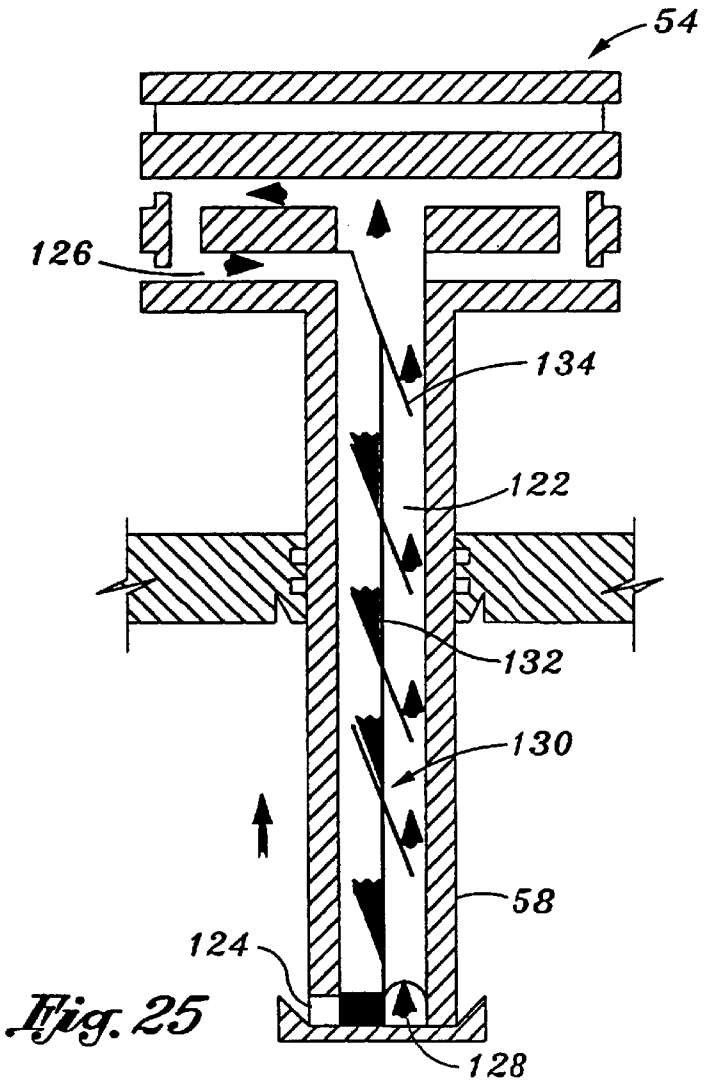
FIG. 25 is a view of the piston illustrated in FIG. 16 shown moving upward and illustrating the movement of lubrication thereby.

Referring to FIG. 25, as the piston 54 moves upwardly, oil is swept off of the piston rod towards the inlet 124. In addition, the inertial forces draw excess lubricant downwardly from the delivery passage 126 through the second passage 125*b* to the outlet 128. At the same time, downward movement of oil from the delivery passage 126 through the first passage 125*a* is inhibited by the partitions 132.

In this cycle, oil is provided to the inlet 124, is forced upwardly through the first passage 125*a* to the delivery passage 126 and weeps. Excess lubricant is then drawn back to the outlet 128.

Operation of the lubricating system for the pistons in accordance with the embodiments illustrated in FIGS. 20–21 will now be described in detail with reference to FIGS. 26–29.

Figure 27:
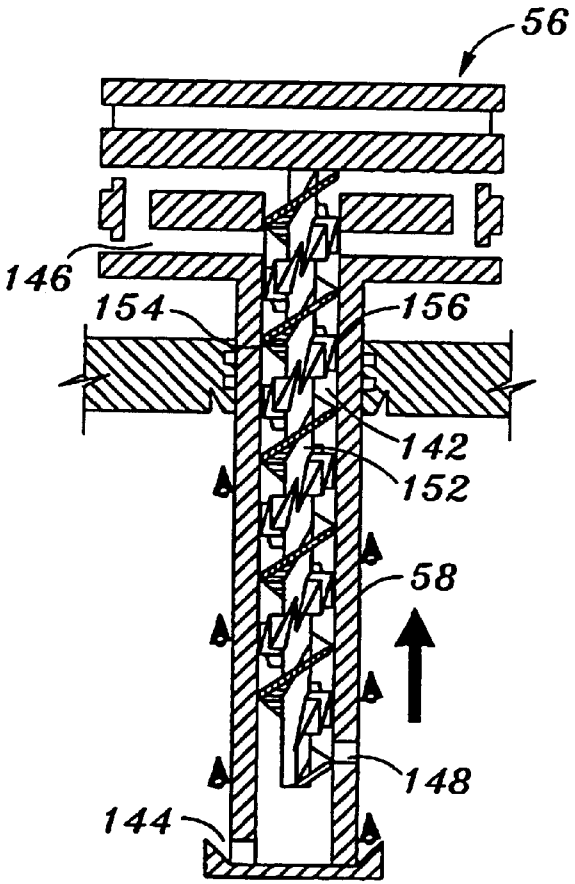
FIG. 27 is a view of the piston illustrated in FIG. 21 shown moving upward and illustrating the movement of lubrication thereby.

Operation of this embodiment system is similar to that described above. In this embodiment system, upward movement of the piston 56 causes lubricant to be directed into the inlet 124, as illustrated in FIG. 27. At this time excess lubricant is directed from the delivery passage 146 to the outlet 148 through the second passage 159*b*. As illustrated in greater detail in FIG. 28, downward flow of the lubricant from the delivery passage 146 to the inlet 144 is prohibited in that the lubricant is trapped by the troughs 157*c* in the first passage 159*a*.

Figure 26:
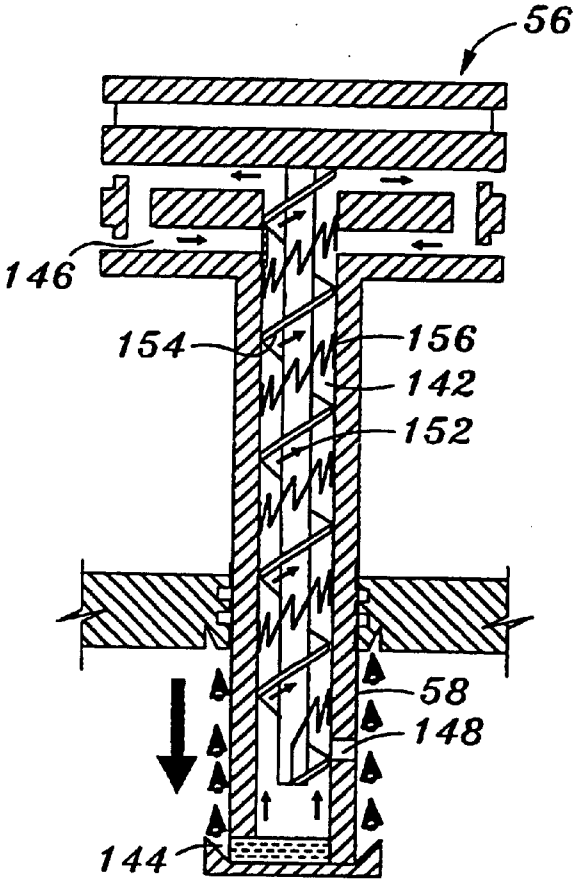
FIG. 26 is a view of the piston illustrated in FIG. 20 shown moving downward and illustrating the movement of lubrication thereby.
Figure 28:
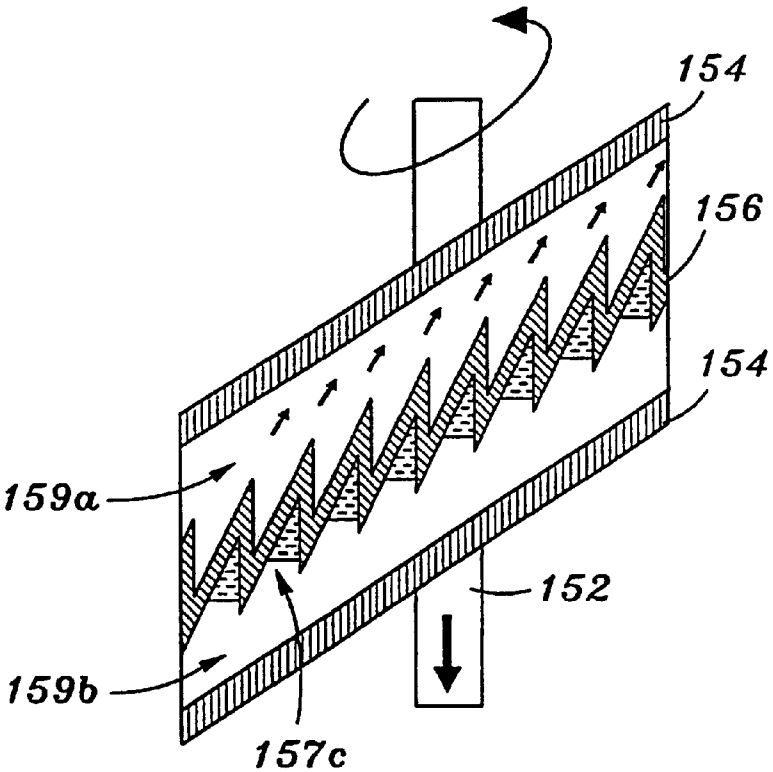
FIG. 28 is an enlarged view of a portion of the piston illustrated in FIG. 26.
Figure 29:
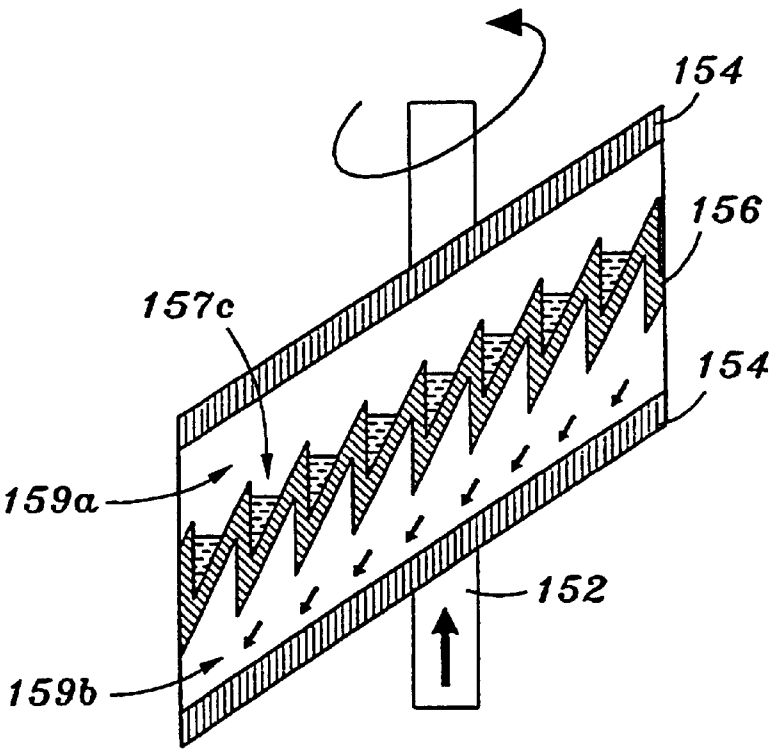
FIG. 29 is an enlarged view of a portion of the piston illustrated in FIG. 27.

Referring to FIG. 26, upon downward movement of the piston 56, lubricant delivered to the trough area and inlet 144 is directed upwardly to the delivery passage 146 through the first passage 159. As illustrated in greater detail in FIG. 29, lubricant is prohibited from moving from the outlet 148 back to the delivery passage 146 through the second passage 159*b* by the troughs 157*c* defined by the flow directing element 156.

Of course, the engine 20 need not be configured exactly as illustrated, and many alternate configurations are contemplated as within the scope of the invention. Further, one or more features of the invention may be used alone or in combination with other elements not described in detail herein.

In one embodiment, the engine 20 may have more than four cylinders or less than four cylinders. For example, the engine 20 may have two cylinders including two opposing pistons. The crankshaft and block of the engine 20 may be elongate and for accommodating six cylinders and six pistons.

The lubricating system described above may be used in a variety of other environments or applications. For example, the lubricating system may be applied to a piston of a four-cycle internal combustion engine of the type now known.

The various components of the engine 20 may be constructed of a wide variety of materials. These materials may include, but are not limited to metal, ceramic and plastic.

The components of the engine 20 may vary from that described above. For example, the cylinder head 32 may be formed with an integral head cap or bottom plate. One or more portions of the cylinder head 32 may also be integrally formed with the block 22. In one arrangement, the bottom plate may actually be formed inside of the engine block, this portion of the engine block thus forming the lower portion of the cylinder.

The valves used to control the flow of air, air and fuel, and exhaust through the engine 20 may vary from that described. For example, electronically controlled valves, such as butterfly or rotating port valves may be utilized. Other means that the cam and follower arrangement may be utilized to move the valve 92. For example, the valve 92 may be moved with a motor.

One advantage to the configuration of the first and second seals 94, 96 being of substantially the same size or surface area is that the pressure of the air within the precombustion chamber 50 acting upon the seals 94, 96 is generally the same. Thus, the pressure of the air does not tend to move the valve 92 in one direction or the other. It will be appreciated that, if desired, one seal or the other may be configured to be larger (and fit within a correspondingly larger portion of the cylinder head 32 defining the chamber 50) to bias the valve 92 into a particular position. For example, the second seal 96 may be slightly larger than the first seal 94, so that when acted upon by an excessively high pressure, the valve 92 is moved upwardly to exhaust the air from the precombustion chamber 50, acting similar to a relief valve.

The various shapes and sizes of the components of the engine 20 may vary. For example, the precombustion chamber may have other than a generally circular cylindrical shape, such as an oval cylindrical shape.

Of course, a number of seals, connectors (such as nuts and bolts) and other elements may be used to achieve the objects of the invention. The particular elements used may depend upon the particular configuration of the engine 20.

The precombustion 50 chamber and precombustion fuel and air mixing aspects of the invention may be applied to engines configured other than as illustrated and described. For example, such an arrangement may be applied to engines having a single cylinder. The engine of the invention also need not include a precombustion chamber 50 with each cylinder 32. Instead, the arrangement of the invention may be used with a cylinder having normal intake and exhaust porting as is known in the art.

Figure 31:
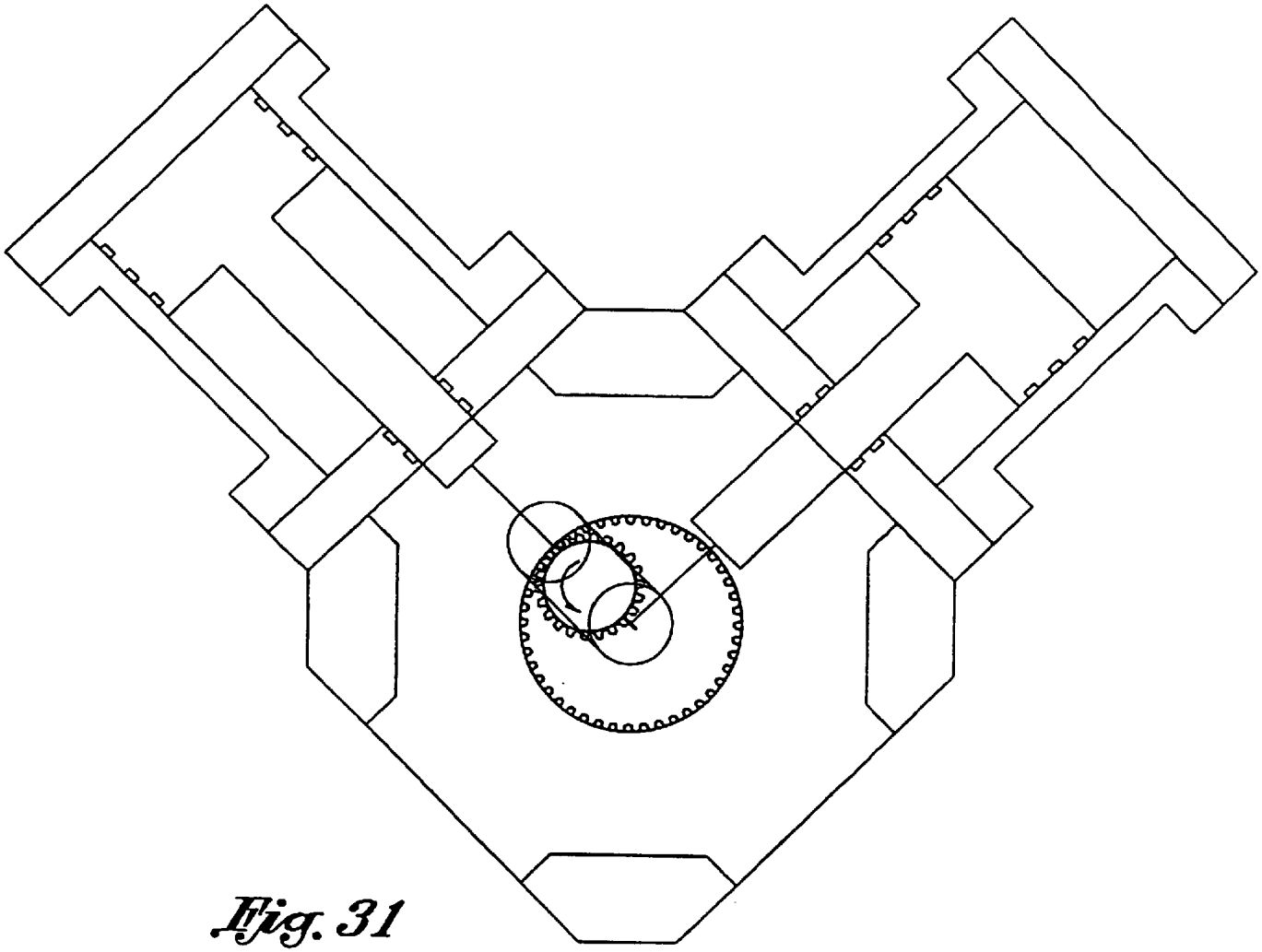
FIG. 31 illustrates an engine in accordance with an embodiment of the invention arranged in a "V" configuration.

In one embodiment, instead of mounting the pistons in pairs to mounting sections of the crankshaft, each piston may be mounted to a different section of the crankshaft. Such an arrangement is advantageous where there are two cylinders or where it is desired to provide a number of cylinders in the same plane. Such an arrangement where the pistons are mounted in a "V" arrangement is illustrated in FIG. 31.

In one embodiment, engine control or management devices or systems may be employed. For example, an O2 sensor may be used to monitor the exhaust of the one or more cylinders. The O2 sensor feedback may be used to control the timing and duration of fuel injection or spark timing.

The start of combustion of the fuel and air mixture may be either in the cylinder bore or in the precombustion chamber. As described above, in a preferred embodiment, combustion is initiated in the precombustion chamber. In this arrangement, combustion is initiated only shortly before or nearly at the same time the valve 92 is moved upwardly (to prevent damage to the precombustion chamber due to overexpansion).

The engine may include other features. For example, a turbo charger or supercharger may be used to pre-compress the intake air. An intercooler may be used to cool the incoming air so that it may be compressed to a higher density.

The principles of the invention may also be applied to an engine having a crankshaft which is non-translating (i.e. rotates about a fixed axis). In such event, however, the length of the rods and cylinder bores may be appropriately adjusted to permit the pistons to move a full range of motion and provide a desired compression ratio.

The embodiments of the invention have numerous advantages. As with conventional two-cycle internal combustion engines, one advantage is that a high power output is realized because each piston has a power stroke every cycle (instead of every other cycle as in a four-stroke engine). On the other hand, problems associated with conventional two-stroke or two-cycle engines are overcome.

First, problems associated with incomplete scavenging in two-cycle engines are overcome. A fresh air charge is not drawn into the cylinder while the exhaust is being exhausted. Instead, the exhaust is completely exhausted during the upward stroke of the piston. Only then is a fresh air charge admitted into the cylinder.

Unlike convention engines, combustion need not begin before the piston reaches top dead center, and thus there is no robbing negative force upon the upwardly rising piston. Instead, combustion may begin after the piston reaches top dead center. In part, this is due to the fact that combustion is permitted during nearly the entire downward stroke of the piston. In addition, because combustion begins in the precombustion chamber, the air and fuel mixture may combust and expand, generating a very high pressure. The highly pressurized mixture is preferably released when it reaches a maximum and at piston top dead center for maximum efficiency.

A higher engine efficiency is realized because the air and fuel charge which is admitted into the cylinder for combustion is at high heat and high pressure. As noted, the fresh air charge is first mechanically compressed by the piston and then thermally compressed within the precombustion chamber. The highly heated and compressed air charge permits more complete burning of fuel and greater energy output during combustion.

Figure 30:
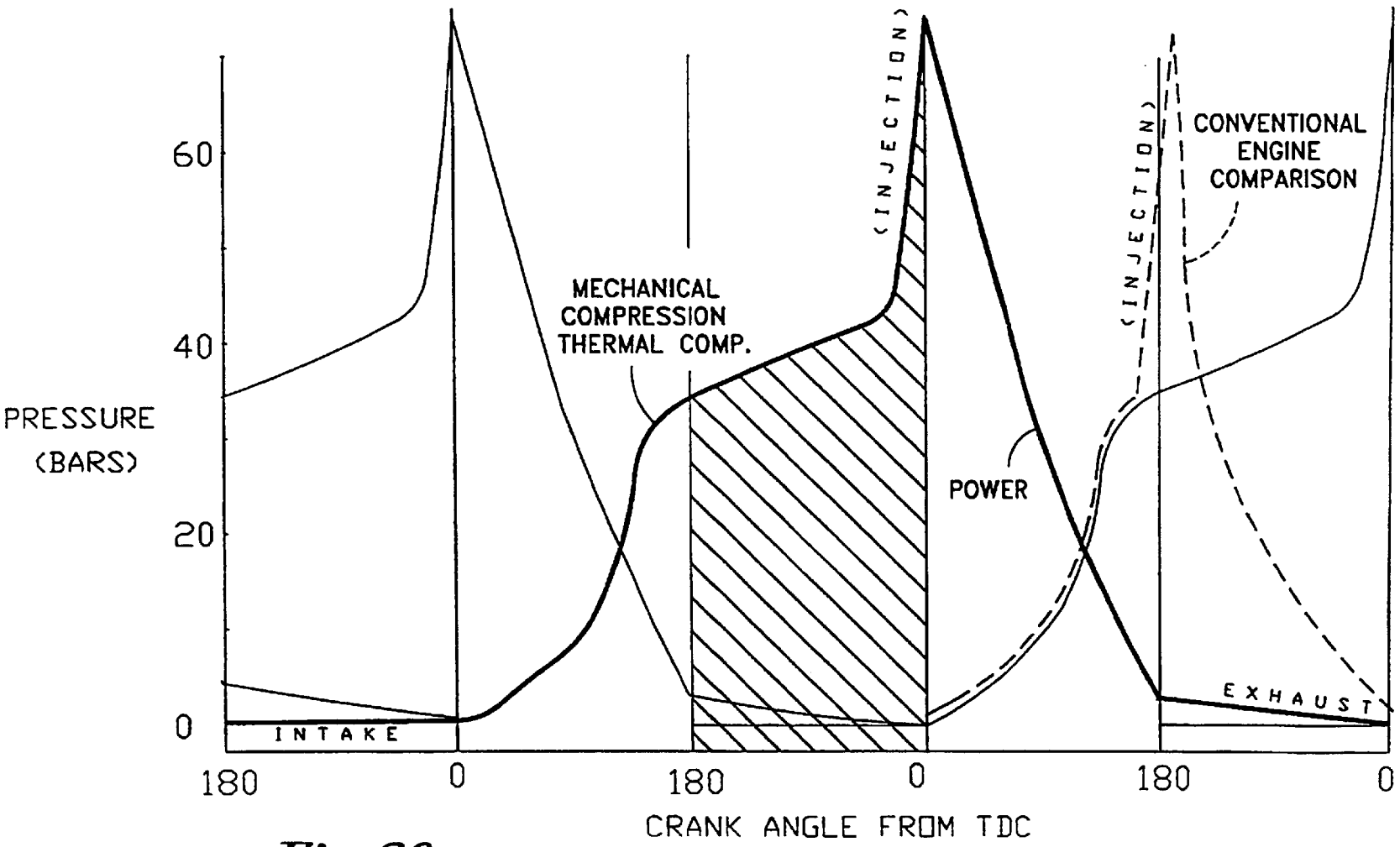
FIG. 30 is a chart illustrating engine pressure versus crankshaft angle during operation of the engine in accordance with the invention.

FIG. 30 is a graph which illustrates pressure of an air charge as it moves through the engine. As illustrated, the air charge enters the intake at substantially ambient pressure. The air charge is the compressed mechanically with the piston, and then thermally by the heat within the precombustion chamber. After fuel injection and delivery to the combustion chamber, the pressure beings to fall as the fuel and air are converted to mechanical energy. By comparison, in a conventional engine greater power is derived as a result of the higher temperatures and pressures and none complete burning of the fuel.

The engine is capable of operating at high speeds. The rods 54 are short, reducing destructive inertial forces. This is due, in part to the translation of the crankshaft 28. Because the crankshaft translates, the piston mounting portion 86 more toward and away from the cylinder during the upward and downward movement of the pistons as a result of the rotation of the crankshaft. As a result, the piston rods 54 can be shorter while a large compression ration is still realized.

The lubricating system as described provides for efficient lubrication of the pistons without the need for complex mechanically or electrically powered pumps, external lines, coolers and similar elements. In addition, the lubricating system has the advantage that it is useful in cooling the pistons.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A two-cycle internal combustion engine comprising a block, at least one cylinder head mounted to said block, a piston movably mounted in a bore defined by said cylinder head, said piston dividing said bore into a first variable volume intake chamber and a second variable volume combustion chamber, said cylinder head further defining a precombustion chamber, said precombustion chamber selectively in communication with said first variable volume intake chamber and said second variable volume combustion chamber, at least one valve member for selectively permitting a compressed charge of air to flow into said precombustion chamber from said first variable volume intake chamber and from said precombustion chamber to said second variable volume combustion chamber, and at least one fuel delivery element adapted to deliver fuel into said air for at least partial combustion in said second variable volume combustion chamber for moving said piston in said bore, said piston connected to a crankshaft and moving said crankshaft as a result of said movement in said bore.

2. The two-cycle internal combustion engine in accordance with claim 1 wherein said cylinder head comprises a body having a first end and a second end, a first member mounted at said first end and a second member mounted at said second end.

3. The two-cycle internal combustion engine in accordance with claim 2 wherein said first member comprises a plate having a passage there through, said plate connected to said block, and wherein said piston includes a rod extending from a head thereof, said rod extending through said passage through said plate into said block.

4. The two-cycle internal combustion engine in accordance with claim 1 including a first passage extending from said first variable volume intake chamber portion of said bore to said precombustion chamber and a second passage extending from said precombustion chamber to said second variable volume combustion chamber portion of said bore.

5. The two-cycle internal combustion engine in accordance with claim 4 including a valve located at least partially in said precombustion chamber, said valve having a first seal thereon for selectively sealing said first passage and a second seal thereon for selectively sealing said second passage.

6. An internal combustion engine comprising a block, at least one head connected to said block and defining a cylinder bore, a piston movably mounted in said cylinder bore, said piston connected to a crankshaft, said block including a first block gear and a second block gear, said crankshaft having a first end and a second end, at least one piston mounting portion located between said ends and positioned along a first axis offset from a second axis through said first and second ends, a first crankshaft gear located at said first end of said crankshaft, said first crankshaft gear smaller than said first block gear and engaging said first block gear, and a second crankshaft gear smaller than said second block gear and located at said second end of said crankshaft, said second crankshaft gear engaging said second block gear, whereby movement of said piston causes said crankshaft to rotate about said second axis and said second axis to move in a generally circular pathway.

7. The internal combustion engine in accordance with claim 6 wherein said first block gear comprises a passage through a first end portion of said block and a plurality of teeth extending into said passage from said block, and wherein said second block gear comprises a passage through a second end portion of said block and a plurality of teeth extending into said passage from said block.

8. The internal combustion engine in accordance with claim 6 wherein said crankshaft includes at least one crankshaft mounting portion between said ends and including at least one eccentric bearing supporting said at least one mounting portion, said at least one eccentric bearing connected to said block.

9. The internal combustion engine in accordance with claim 6 wherein said crankshaft includes a first crankshaft mounting portion and a second crankshaft mounting portion, a first eccentric bearing supported by said block and engaging said first crankshaft mounting portion and a second eccentric bearing supported by said block and engaging said second crankshaft mounting portion.

10. The internal combustion engine in accordance with claim 9 wherein at least one of said first and second eccentric bearings defines a cam surface.

11. The internal combustion engine in accordance with claim 6 further including an output shaft coupled to said first or second end of said crankshaft, said output shaft including a universal joint.

12. A lubricating system for a piston of an internal combustion engine, said piston having a head and a rod, a first end of said rod coupled to said head and a second end of said rod located opposite said first end thereof, a passage through said rod generally extending from said first end to said second end, an inlet leading from an exterior of said second end to said passage, at least one delivery passage located in said head and extending from said passage in head and returning to said passage in said rod, and an outlet from said passage in rod, at least one partition dividing said passage through said rod into an inlet passage leading from said inlet to said delivery passage and an outlet passage leading from said delivery passage to said outlet, and at least one lubrication directing element located in said inlet passage and outlet passage, said at least one lubrication directing element generally inhibiting the flow of lubricant from said delivery passage to said inlet and from said outlet to said delivery passage.

13. The lubricating system in accordance with claim 12 wherein said at least one lubrication directing element comprises a generally oval element, said element oriented at an angle with respect to said partition.

14. The lubricating system in accordance with claim 13 wherein said oval element has a first end and a second end, said first end located in said inlet passage and said second end located in said outlet passage.

15. The lubricating system in accordance with claim 14 including a cut out area located at said first and second ends of said oval element.

16. The lubricating system in accordance with claim 12 including a divider located in said passage in said rod, said divider defining a generally helical passage through said rod.

17. The lubricating system in accordance with claim 16 wherein said lubrication directing element is positioned in said helical passage and divides said passage into helical inlet passage and helical outlet passage.

18. A two-cycle internal combustion engine comprising a block having a first end and a second end, a crankshaft rotatably supported by said ends of said block, said crankshaft having a first end with a gear thereon engaging a first block gear at said first end of said block and said crankshaft having a second end with a gear thereon engaging a second block gear at said second end of said block, said crankshaft including at least one piston mounting portion, said at least one piston mounting portion extending along a first axis offset from a second axis through said ends of said crankshaft, said crankshaft rotatably supported by said block with at least one eccentric bearing permitting said crankshaft to rotate about said second axis and to translate, at least one piston connected to said at least one mounting portion of said crankshaft, said piston including a rod connected to said crankshaft and a head, said head located in a cylinder bore defined by a cylinder head connected to said block, said cylinder bore generally closed at a top end and a bottom end thereof, said head of said piston dividing said cylinder bore into a variable volume intake chamber below said head and a variable volume combustion chamber above said head, an intake port leading from an exterior of said engine to said variable volume combustion chamber and a valve adapted to selectively open and close said intake port, said cylinder head defining a precombustion chamber, a compression port leading from said variable volume intake chamber to said precombustion chamber, a bi-directional port leading from said precombustion chamber to said variable volume combustion chamber, at least one valve adapted to selectively open and close said compression port and bi-directional port, a fuel delivery mechanism adapted to deliver fuel into said precombustion chamber, and a cam rotated by said crankshaft and arranged to drive said at least one valve adapted to selectively open and close said compression port.

19. The two-cycle internal combustion engine in accordance with claim 18 wherein said block has four sides, a cylinder head coupled to each of said sides and a piston movably mounted in each of said cylinder heads, said pistons connected to said crankshaft.

20. The two-cycle internal combustion engine in accordance with claim 18 including a follower having a first end engaging said cam and a second end engaging a rocker, said rocker adapted to move said at least one valve adapted to selectively open and close said compression port and bi-directional port.

21. The two-cycle internal combustion engine in accordance with claim 18 including at least two opposing pistons, said pistons connected to one another about a mounting portion of said crankshaft.

22. A method of operating an internal combustion engine including a piston movably mounted in a cylinder bore, said piston connected to a crankshaft comprising:

drawing an air charge into a variable volume combustion chamber below a head of said piston;

compressing said air charge as said piston moves downwardly in said bore;

releasing said compressed air charge into a precombustion chamber;

heating said compressed air charge in said precombustion chamber;

adding fuel to said heated and compressed air charge in said precombustion chamber;

releasing said fuel and air from said precombustion chamber into a combustion chamber above said piston head;

igniting said fuel and air mixture thereby driving said piston downwardly; and moving said piston upwardly driving exhaust from said combustion chamber.

23. The method in accordance with claim 22 including the step of rotating and translating said crankshaft to which said piston is coupled.

* * * * *